US009181816B2

(12) United States Patent
Lee et al.

(10) Patent No.: US 9,181,816 B2
(45) Date of Patent: Nov. 10, 2015

(54) SEAL ASSEMBLY INCLUDING GROOVES IN AN AFT FACING SIDE OF A PLATFORM IN A GAS TURBINE ENGINE

(71) Applicant: Siemens Aktiengesellschaft, München (DE)

(72) Inventors: Ching-Pang Lee, Cincinnati, OH (US); Kok-Mun Tham, Oviedo, FL (US); Eric Schroeder, Loveland, OH (US); Erik Johnson, Cincinnati, OH (US); Dustin Muller, Cincinnati, OH (US); Steven Coppess, Cincinnati, OH (US); Manjit Shivanand, Winter Springs, FL (US); Kahwai G. Muriithi, Grennville, SC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/189,227

(22) Filed: Feb. 25, 2014

(65) Prior Publication Data

US 2014/0205443 A1 Jul. 24, 2014

Related U.S. Application Data

(63) Continuation-in-part of application No. 14/043,958, filed on Oct. 2, 2013, and a continuation-in-part of application No. 13/747,868, filed on Jan. 23, 2013.

(51) Int. Cl.
*F01D 11/00* (2006.01)
*F01D 11/02* (2006.01)

(52) U.S. Cl.
CPC ..... *F01D 11/001* (2013.01); *F01D 11/02* (2013.01); *F05D 2240/80* (2013.01); *F05D 2250/37* (2013.01); *F05D 2250/38* (2013.01); *F05D 2250/71* (2013.01); *F05D 2260/14* (2013.01)

(58) Field of Classification Search
CPC ..... F01D 11/00; F01D 11/001; F01D 11/02; F01D 11/005; F01D 9/065
USPC ..... 415/115–116, 182.1, 183, 185, 191; 416/193 A
See application file for complete search history.

(56) References Cited

U.S. PATENT DOCUMENTS 6,077,035 A 6/2000 Walters et al.
6,152,690 A 11/2000 Tomita et al.

(Continued)

FOREIGN PATENT DOCUMENTS

EP 1582697 A1 5/2005

*Primary Examiner* — Dwayne J White
*Assistant Examiner* — Christopher J Hargitt

(57) ABSTRACT

A seal assembly between a disc cavity and a hot gas path in a gas turbine engine includes a stationary vane assembly and a rotating blade assembly axially upstream from the vane assembly. A platform of the blade assembly has a radially outwardly facing first surface, an axially downstream facing second surface defining an aft plane, and a plurality of grooves extending into the second surface such that the grooves are recessed from the aft plane The grooves are arranged such that a circumferential space is defined between adjacent grooves During operation of the engine, the grooves impart a circumferential velocity component to purge air flowing out of a disc cavity through the grooves to guide the purge air toward a hot gas path such that the purge air flows in a desired direction with reference to a direction of hot gas flow through the hot gas path.

19 Claims, 14 Drawing Sheets

(56) References Cited

U.S. PATENT DOCUMENTS

| | | | | |
|---|---|---|---|---|
| 6,832,893 | B2 | 12/2004 | Chevrefils et al. | |
| 6,887,039 | B2 | 5/2005 | Soechting et al. | |
| 7,044,710 | B2 | 5/2006 | Naik et al. | |
| 7,114,339 | B2 * | 10/2006 | Alvanos et al. | 60/806 |
| 7,189,055 | B2 | 3/2007 | Marini et al. | |
| 7,244,104 | B2 * | 7/2007 | Girgis et al. | 416/193 A |
| 7,249,928 | B2 | 7/2007 | Klasing et al. | |
| 8,075,256 | B2 | 12/2011 | Little | |
| 8,282,346 | B2 | 10/2012 | Deodhar et al. | |
| 8,356,975 | B2 | 1/2013 | Grover et al. | |
| 2006/0269399 | A1 | 11/2006 | Girgis et al. | |
| 2010/0074734 | A1 | 3/2010 | Little | |

* cited by examiner

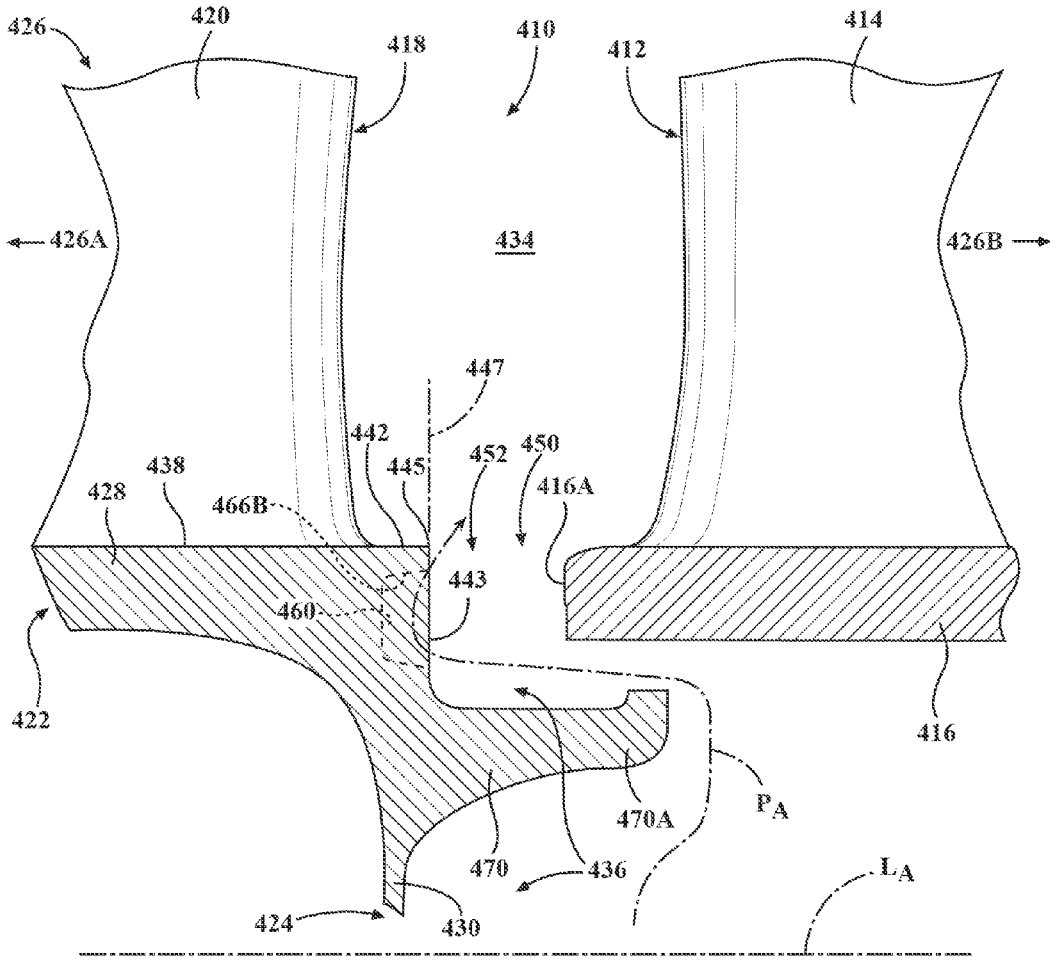
FIG. 9
FIG. 11A
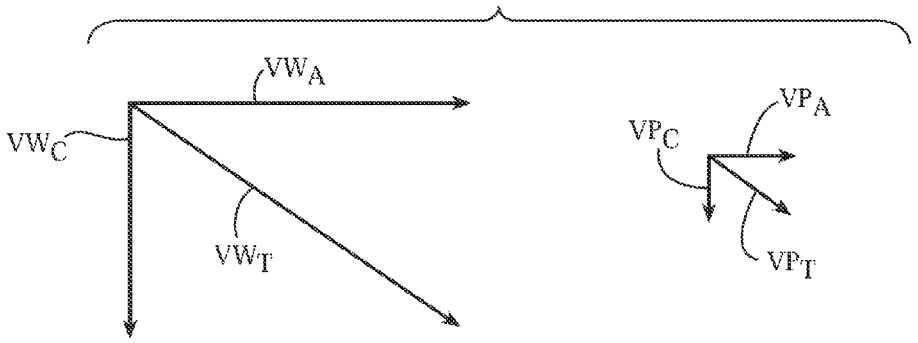

SEAL ASSEMBLY INCLUDING GROOVES IN AN AFT FACING SIDE OF A PLATFORM IN A GAS TURBINE ENGINE

CROSS REFERENCE TO RELATED APPLICATIONS

This application is a Continuation-In-Part of U.S. patent application Ser. No. 14/043,958, filed Oct. 2, 2013, entitled "SEAL ASSEMBLY INCLUDING GROOVES IN A RADIALLY OUTWARDLY FACING SIDE OF A PLATFORM IN A GAS TURBINE ENGINE" by Ching-Pang Lee, the entire disclosure of which is incorporated by reference herein. This application and U.S. patent application Ser. No. 14/043,958 are Continuations-In-Part of U.S. patent application Ser. No. 13/747,868, filed Jan. 23, 2013, entitled "SEAL ASSEMBLY INCLUDING GROOVES IN AN INNER SHROUD IN A GAS TURBINE ENGINE" by Ching-Pang Lee, the entire disclosure of which is incorporated by reference herein.

FIELD OF THE INVENTION

The present invention relates generally to a seal assembly for use in a gas turbine engine that includes a plurality of grooves located on a radially outer side of rotatable blade platform for assisting in limiting leakage between a hot gas path and a disc cavity

BACKGROUND OF THE INVENTION

In multistage rotary machines such as gas turbine engines, a fluid, e.g, intake air, is compressed in a compressor section and mixed with a fuel in a combustion section. The mixture of air and fuel is ignited in the combustion section to create combustion gases that define a hot working gas that is directed to turbine stage(s) within a turbine section of the engine to produce rotational motion of turbine components Both the turbine section and the compressor section have stationary or non-rotating components, such as vanes, for example, that cooperate with rotatable components, such as blades, for example, for compressing and expanding the hot working gas. Many components within the machines must be cooled by a cooling fluid to prevent the components from overheating.

Ingestion of hot working gas from a hot gas path to disc cavities in the machines that contain cooling fluid reduces engine performance and efficiency, eg, by yielding higher disc and blade root temperatures Ingestion of the working gas from the hot gas path to the disc cavities may also reduce service life and/or cause failure of the components in and around the disc cavities

SUMMARY OF THE INVENTION

In accordance with a first aspect of the invention, a seal assembly is provided between a disc cavity and a hot gas path that extends through a turbine section of a gas turbine engine. The seal assembly comprises a stationary vane assembly including a plurality of vanes and an inner shroud, and a rotating blade assembly axially upstream from the vane assembly and including a plurality of blades that are supported on a platform and rotate with a turbine rotor and the platform during operation of the engine, the axial direction defined by a longitudinal axis of the turbine section The platform comprises a radially outwardly facing first surface, an axially downstream facing second surface extending radially inwardly from a junction between the first surface and the second surface, the second surface defining an aft plane, and a plurality of grooves extending into the second surface such that the grooves are recessed from the aft plane defined by the second surface The grooves are arranged such that a space having a component in a circumferential direction is defined between adjacent grooves, the circumferential direction corresponding to a direction of rotation of the blade assembly. During operation of the engine, the grooves impart a circumferential velocity component to purge air flowing out of the disc cavity through the grooves to guide the purge air toward the hot gas path such that the purge air flows in a desired direction with reference to a direction of hot gas flow through the hot gas path.

The grooves may include first sidewalls and second sidewalls, the first sidewalls being located circumferentially upstream from the second sidewalls.

Axial depths of the grooves may increase gradually from the first sidewalls to the second sidewalls The second sidewalls of the grooves may include a generally planar circumferentially facing endwall that extends generally radially outwardly from entrances of the grooves to exits thereof Radially inner corner portions of the endwalls of the grooves may be curved in the circumferentially upstream direction to create a ramped surface for cooling air passing through the grooves.

Exits of the grooves may be radially displaced from the junction between first and second surfaces of the platform.

The grooves may include radially outer exit walls defining the exits of the grooves and that face radially inwardly and axially downstream.

The grooves guide the purge air therethrough such that a flow direction of the purge air exiting the grooves may be generally aligned with the direction of hot gas flow through the hot gas path at axial locations corresponding to where the purge air exits the grooves.

The platform may further comprise a generally axially extending seal structure that extends from the platform toward and to within close proximity of the inner shroud of the adjacent downstream vane assembly.

The platform may further comprise a third surface facing an axially upstream direction; and a plurality of blade grooves extending into the third surface of the platform, the blade grooves being arranged such that a space having a component in the circumferential direction is defined between adjacent blade grooves, wherein, during operation of the engine, the blade grooves guide purge air out of an axially upstream disc cavity toward the hot gas path such that the purge air flows in a desired direction with reference to the direction of hot gas flow through the hot gas path The third surface of the platform may face axially upstream and radially outwardly. Further the inner shroud may comprise a radially outwardly facing first surface; a radially inwardly facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide purge air toward the hot gas path such that the purge air flows in a desired direction with reference to the direction of hot gas flow through the hot gas path. The second surface of the inner shroud may face axially downstream and radially inwardly. The blade grooves may be tapered from entrances thereof located distal from the first surface of the platform to exits thereof located proximate to the first surface of the platform such that the entrances of the blade grooves are wider than the exits of the blade grooves, and the vane grooves may be tapered from entrances thereof located distal from an axial end portion of the inner shroud to exits thereof located proximate to the axial end portion of the inner shroud such that the entrances of the vane grooves are wider than the exits of the vane grooves.

In accordance with a second aspect of the invention, a seal assembly is provided between a disc cavity and a hot gas path that extends through a turbine section of a gas turbine engine including a turbine rotor. The seal assembly comprises a stationary vane assembly including a plurality of vanes and an inner shroud, and a rotating blade assembly axially upstream from the vane assembly and including a plurality of blades that are supported on a platform and rotate with a turbine rotor and the platform during operation of the engine, the axial direction defined by a longitudinal axis of the turbine section The platform comprises a radially outwardly facing first surface, an axially downstream facing second surface extending radially inwardly from a junction between the first surface and the second surface, the second surface defining an aft plane, and a plurality of grooves extending into the second surface such that the grooves are recessed from the aft plane defined by the second surface. The grooves are arranged such that a space having a component in a circumferential direction is defined between adjacent grooves, the circumferential direction corresponding to a direction of rotation of the blade assembly. Axial depths of the grooves increase from first sidewalls of the grooves to second sidewalls of the grooves spaced circumferentially downstream from the first sidewalls, and exits of the grooves are radially displaced from the junction between first and second surfaces of the platform. During operation of the engine, the grooves impart a circumferential velocity component to purge air flowing out of the disc cavity through the grooves to guide the purge air therethrough such that a flow direction of the purge air exiting the grooves is generally aligned with a direction of hot gas flow through the hot gas path at axial locations corresponding to where the purge air exits the grooves.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein.

FIG. 9 is a diagrammatic sectional view of a portion of a turbine stage in a gas turbine engine including a seal assembly in accordance with another embodiment of the invention.

FIG. 11A is a diagram illustrating velocity vectors for hot working gas and purge air as depicted in FIG. 11.

DETAILED DESCRIPTION OF THE INVENTION

In the following detailed description of preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
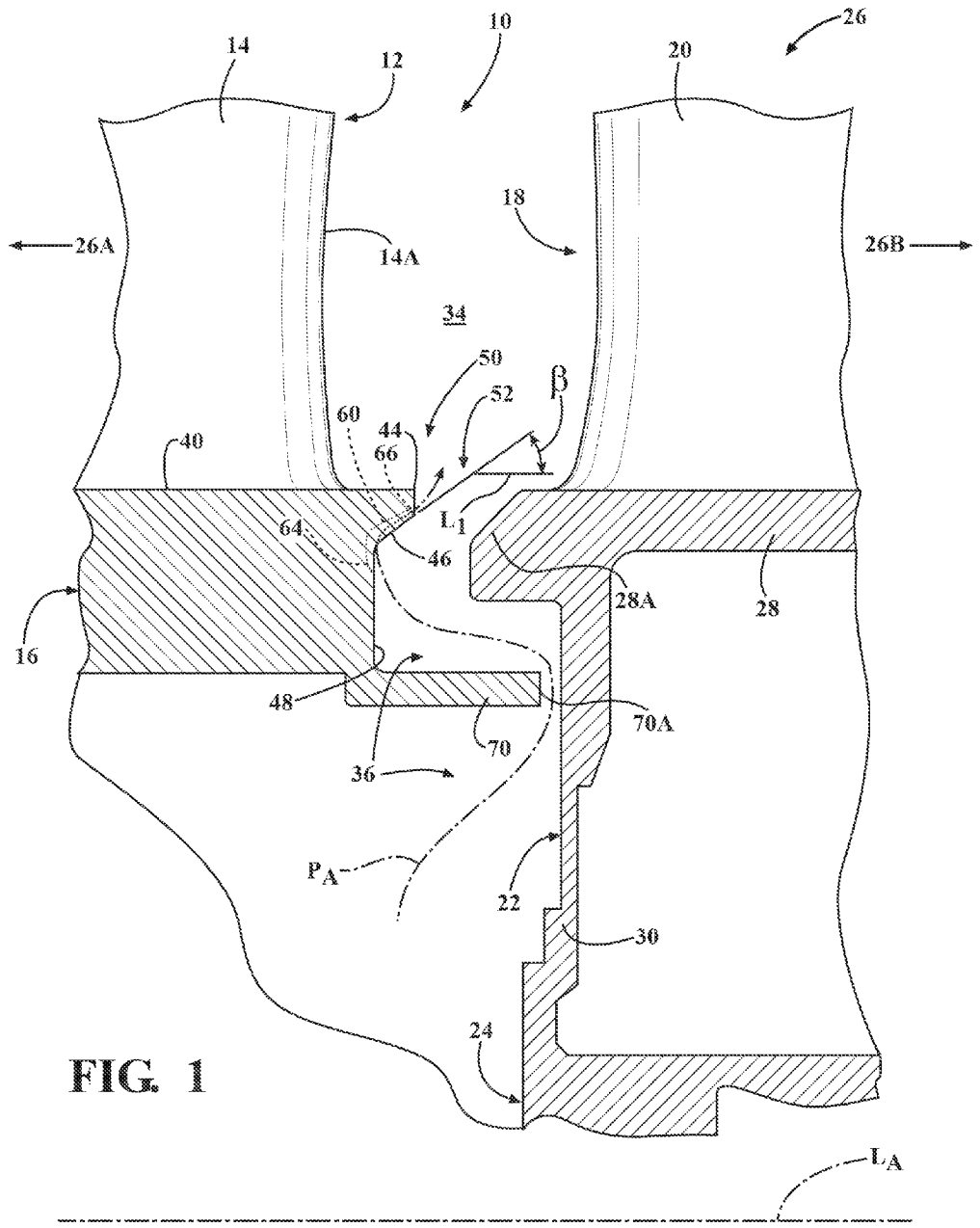
FIG. 1 is a diagrammatic sectional view of a portion of a turbine stage in a gas turbine engine including a seal assembly in accordance with an embodiment of the invention.

Referring to FIG. 1, a portion of a turbine engine 10 is illustrated diagrammatically including a stationary vane assembly 12 including a plurality of vanes 14 suspended from an outer casing (not shown) and affixed to an annular inner shroud 16, and a blade assembly 18 including a plurality of blades 20 and rotor disc structure 22 that forms a part of a turbine rotor 24 The vane assembly 12 and the blade assembly 18 may be collectively referred to herein as a "stage" of a turbine section 26 of the engine 10, which may include a plurality of stages as will be apparent to those having ordinary skill in the art. The vane assemblies 12 and blade assemblies 18 are spaced apart from one another in an axial direction defining a longitudinal axis $L_A$ of the engine 10, wherein the vane assembly 12 illustrated in FIG. 1 is upstream from the illustrated blade assembly 18 with respect to an inlet 26A and an outlet 26B of the turbine section 26, see FIGS. 1 and 3.

The rotor disc structure 22 may comprise a platform 28, a blade disc 30, and any other structure associated with the blade assembly 18 that rotates with the rotor 24 during operation of the engine 10, such as, for example, roots, side plates, shanks, etc.

The vanes 14 and the blades 20 extend into an annular hot gas path 34 defined within the turbine section 26 A working gas $H_G$ (see FIG. 3) comprising hot combustion gases is directed through the hot gas path 34 and flows past the vanes 14 and the blades 20 to remaining stages during operation of the engine 10 Passage of the working gas $H_G$ through the hot gas path 34 causes rotation of the blades 20 and the corresponding blade assembly 18 to provide rotation of the turbine rotor 24.

Referring to FIG. 1, a disc cavity 36 is located radially inwardly from the hot gas path 34 between the annular inner shroud 16 and the rotor disc structure 22. Purge air $P_A$, such as, for example, compressor discharge air, is provided into the disc cavity 36 to cool the inner shroud 16 and the rotor disc structure 22 The purge air $P_A$ also provides a pressure balance against the pressure of the working gas $H_G$ flowing through the hot gas path 34 to counteract a flow of the working gas $H_G$ into the disc cavity 36 The purge air $P_A$ may be provided to the disc cavity 36 from cooling passages (not shown) formed through the rotor 24 and/or from other upstream passages (not shown) as desired It is noted that additional disc cavities (not shown) are typically provided between remaining inner shrouds 16 and corresponding adjacent rotor disc structures 22.

Figure 2:
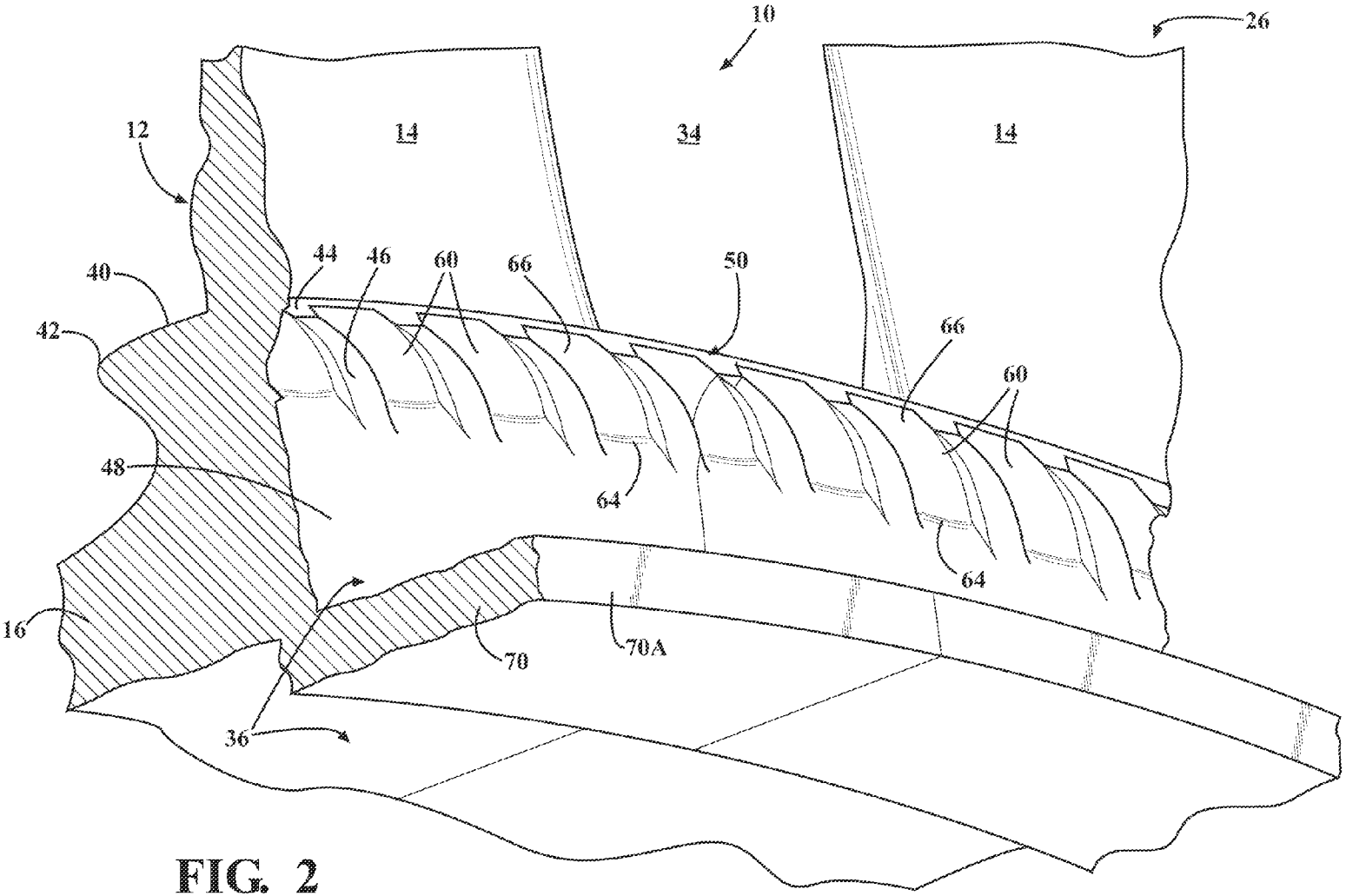
FIG. 2 is a fragmentary perspective view of a plurality of grooves of the seal assembly of FIG. 1.
Figure 3:
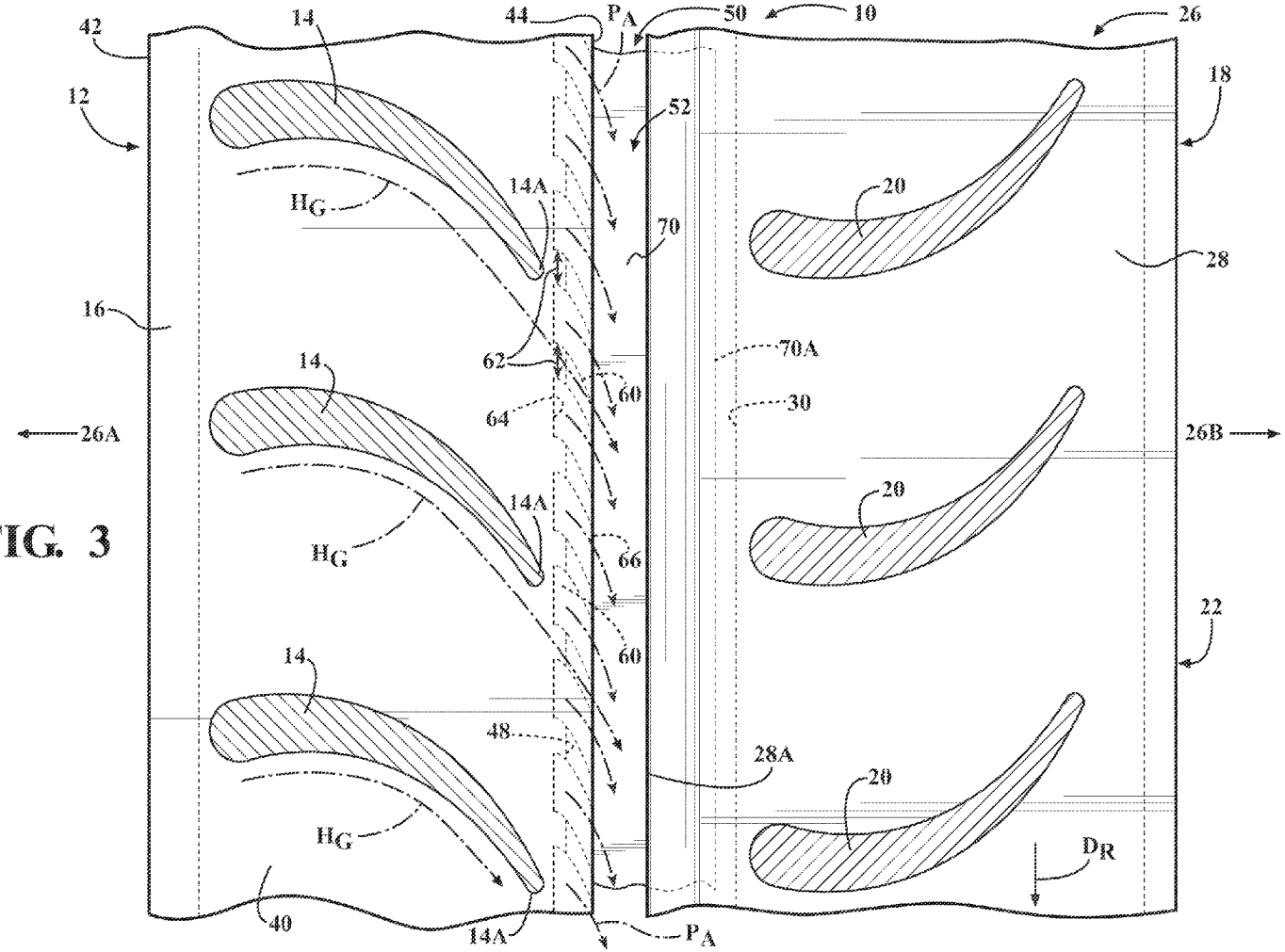
FIG. 3 is a cross sectional view of the stage illustrated in FIG. 1 looking in a radially inward direction.

As shown in FIGS. 1-3, the inner shroud 16 in the embodiment shown comprises a generally radially facing extending first surface 40 from which the vanes 14 extend. The first surface 40 in the embodiment shown extends from an axially upstream end portion 42 of the inner shroud 16 to an axially downstream end portion 44, see FIGS. 2 and 3. The inner shroud 16 further comprises a radially inwardly and axially downstream facing second surface 46 that extends from the axially downstream end portion 44 of the inner shroud 16 away from the adjacent blade assembly 18 to a generally axially facing third surface 48 of the inner shroud 16, see FIGS. 1 and 2. The second surface 46 of the inner shroud 16 in the embodiment shown extends from the downstream end portion 44 at an angle β relative to a line L1 that is parallel to the longitudinal axis $L_A$, i.e., such that the second surface 46 also extends from the downstream end portion 44 at the angle β relative to the longitudinal axis $L_A$, which angle β is preferably between about 30-60° and is about 45° in the embodiment shown, see FIG. 1. The third surface 48 extends radially inwardly from the second surface 46 and faces the rotor disc structure 22 of the adjacent blade assembly 18

Components of the inner shroud 16 and the rotor disc structure 22 radially inwardly from the respective vanes 14 and blades 20 cooperate to form an annular seal assembly 50 between the hot gas path 34 and the disc cavity 36. The annular seal assembly 50 assists in preventing ingestion of the working gas $H_G$ from the hot gas path 34 into the disc cavity 36 and delivers a portion of the purge air $P_A$ out of the disc cavity 36 in a desired direction with reference to a flow direction of the working gas $H_G$ through the hot gas path 34 as will be described herein. It is noted that additional seal assemblies 50 similar to the one described herein may be provided between the inner shrouds 16 and the adjacent rotor disc structures 22 of the remaining stages in the engine 10, i.e., for assisting in preventing ingestion of the working gas $H_G$ from the hot gas path 34 into the respective disc cavities 36 and to deliver purge air $P_A$ out of the disc cavities 36 in a desired direction with reference to the flow direction of the working gas $H_G$ through the hot gas path 34 as will be described herein.

As shown in FIGS. 1-3, the seal assembly 50 comprises portions of the vane and blade assemblies 12, 18 Specifically, in the embodiment shown, the seal assembly 50 comprises the second and third surfaces 46, 48 of the inner shroud 16 and an axially upstream end portion 28A of the platform 28 of the rotor disc structure 22. These components cooperate to define an outlet 52 for the purge air $P_A$ out of the disc cavity 36, see FIGS. 1 and 3.

Figure 2A:
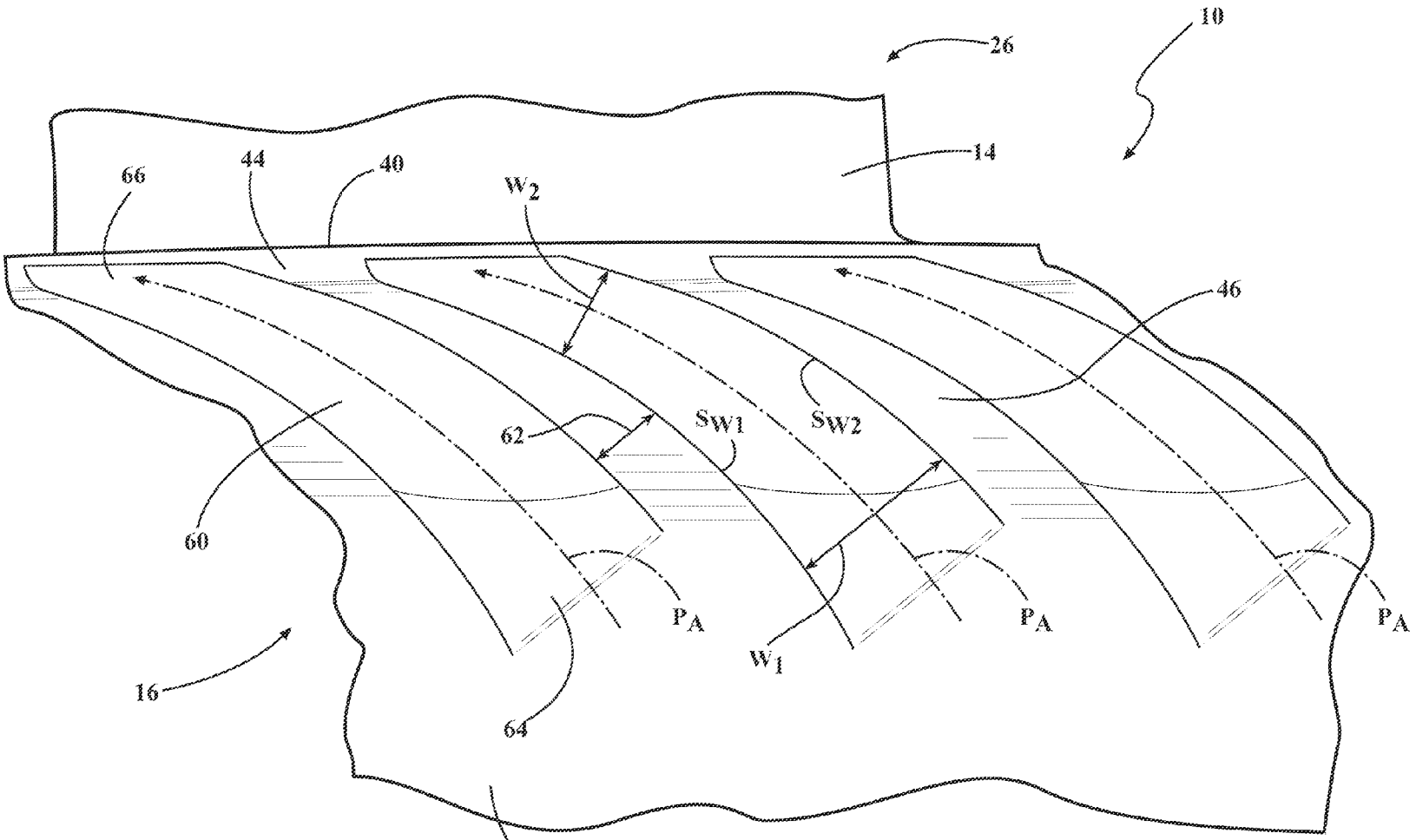
FIG. 2A is an elevational view of a number of the grooves illustrated in FIG. 2.

The seal assembly 50 further comprises a plurality of grooves 60, also referred to herein as vane grooves, extending into the second and third surfaces 46, 48 of the inner shroud 16 The grooves 60 are arranged such that spaces 62 having components in a circumferential direction are defined between adjacent grooves 60, see FIGS. 2 and 3 The size of the spaces 62 may vary depending on the particular configuration of the engine 10 and may be selected to fine tune discharging of purge air $P_A$ from the grooves 60, wherein the discharging of the purge air $P_A$ from the grooves 60 will be discussed in more detail below As shown most clearly in FIG. 2, entrances 64 of the grooves 60, i.e., where purge air $P_A$ from the disc cavity 36 to be discharged toward the hot gas path 34 enters the grooves 60, are located distal from the axial end portion 44 of the inner shroud 16 in the third surface 48 thereof, and outlets or exits 66 of the grooves 60, i.e., where the purge air $P_A$ is discharged from the grooves 60, are located proximate to the axial end portion 44 of the inner shroud 16 in the second surface 46 thereof. Referring to FIG. 2A, the grooves 60 are preferably tapered from the entrances 64 thereof to the exits 66 thereof such that widths $W_1$ of the entrances 64 are wider than widths $W_2$ of the exits 66, wherein the widths $W_1$, $W_2$ are respectively measured between opposing side walls $S_{W1}$, $S_{W2}$ of the inner shroud 16 that define the grooves 60 in directions substantially perpendicular to the general flow direction of the purge air $P_A$ through the respective grooves 60 The tapering of the grooves 60 in this manner is believed to provide a more concentrated and influential discharge of the purge air $P_A$ out of the grooves 60 so as to more effectively prevent ingestion of the working gas $H_G$ into the disc cavity 36 as will be described below As shown in FIG. 3, the grooves 60 are also preferably angled and/or curved in the circumferential direction such that the entrances 64 thereof are located upstream from the exits 66 thereof with reference to a direction of rotation $D_R$ of the turbine rotor 24. Angling and/or curving the grooves 60 in this manner effects a guidance of the purge air $P_A$ from the disc cavity 36 out of the grooves 60 toward the hot gas path 34 such that the purge air $P_A$ flows in a desired direction with reference to the flow of the working gas $H_G$ through the hot gas path 34. Specifically, the grooves 60 according to this aspect of the invention guide the purge air $P_A$ out of the disc cavity 36 such that a flow direction of the purge air $P_A$ is generally aligned with a flow direction of the working gas $H_G$ at a corresponding axial location of the hot gas path 34, which flow direction of the working gas $H_G$ at the corresponding axial location of the hot gas path 34 is generally parallel to exit angles of trailing edges 14A of the vanes 14.

Referring to FIGS. 1-3, the seal assembly 50 further comprises a generally axially extending seal structure 70 of the inner shroud 16 that extends from the third surface 48 thereof toward the blade disc 30 of the blade assembly 18 As shown in FIGS. 1 and 3, an axial end 70A of the seal structure 70 is in close proximity to the blade disc 30 of the blade assembly 18. The seal structure 70 may be formed as an integral part of the inner shroud 16, or may be formed separately from the inner shroud 16 and affixed thereto. As shown in FIG. 1, the seal structure 70 preferably overlaps the upstream end 28A of the platform 28 such that any ingestion from the hot gas path 34 into the disc cavity 36 must travel through a tortuous path.

During operation of the engine 10, passage of the hot working gas $H_G$ through the hot gas path 34 causes the blade assembly 18 and the turbine rotor 24 to rotate in the direction of rotation $D_R$ shown in FIG. 3

A pressure differential between the disc cavity 36 and the hot gas path 34, i.e., the pressure in the disc cavity 36 is greater than the pressure in the hot gas path 34, causes purge air $P_A$ located in the disc cavity 36 to flow toward the hot gas path 34, see FIG. 1. As the purge air $P_A$ reaches the third surface 48 of the inner shroud 36, a portion of the purge air $P_A$ flows into the entrances 64 of the grooves 60. This portion of the purge air $P_A$ flows radially outwardly through the grooves 60 and then, upon reaching the portions of the grooves 60 within the second surface 46 of the inner shroud 16, the purge air $P_A$ flows radially outwardly and axially within the grooves 60 toward the adjacent blade assembly 18. Due to the angling and/or curving of the grooves 60 as discussed above, the purge air $P_A$ is provided with a circumferential velocity component such that the purge air $P_A$ is discharged out of the grooves 60 in generally the same direction as the working gas $H_G$ is flowing after exiting the trailing edges 14A of the vanes 14, see FIG. 3

The discharge of the purge air $P_A$ from the grooves 60 assists in limiting ingestion of the hot working gas $H_G$ from the hot gas path 34 into the disc cavity 36 by forcing the working gas $H_G$ away from the seal assembly 50. Since the seal assembly 50 limits working gas $H_G$ ingestion from the hot gas path 34 into the disc cavity 36, the seal assembly 50 allows for a smaller amount of purge air $P_A$ to be provided to the disc cavity 36, thus increasing engine efficiency.

Moreover, since the purge air $P_A$ is discharged out of the grooves 60 in generally the same direction that the working gas $H_G$ flows through the hot gas path 34 after exiting the trailing edges 14A of the vanes 14, there is less pressure loss associated with the purge air $P_A$ mixing with the working gas $H_G$, thus additionally increasing engine efficiency. This is especially realized by the grooves 60 of the present invention since they are formed in the downstream end portion 44 of the inner shroud 16, such that the purge air $P_A$ discharged from the grooves 60 flows axially in the downstream flow direction of the hot working gas $H_G$ through the hot gas path 34, in addition to the purge air $P_A$ being discharged from the grooves 60 in generally the same circumferential direction as the flow of hot working gas $H_G$ after exiting the trailing edges 14A of the vanes 14, ie, as a result of the grooves 60 being angled and/or curved in the circumferential direction The grooves 60 formed in the inner shroud 16 are thus believed to provide less pressure loss associated with the purge air $P_A$ mixing with the working gas $H_G$ than if they were formed in the upstream end portion 28A of the platform 28, as purge air discharged out of grooves formed in the upstream end portion 28A of the platform 28 would flow axially upstream with regard to the flow direction of the hot working gas $H_G$ through the hot gas path 34, thus resulting in higher pressure losses associated with the mixing.

It is noted that the angle and/or curvature of the grooves 60 could be varied to fine tune the discharge direction of the purge air $P_A$ out of the grooves 60. This may be desirable based on the exit angles of trailing edges 14A of the vanes 14 and/or to vary the amount of pressure loss associated with the purge air $P_A$ mixing with the working gas $H_G$ flowing through the hot gas path 34

Further, the entrances 64 of the grooves 60 could be located further radially inwardly or outwardly in the third surface 48 of the inner shroud 16, or the entrances 64 could be located in the second surface 46 of the inner shroud 16, i.e., such that the entireties of the grooves 60 would be located in the second surface 46 of the inner shroud 16.

Finally, the grooves 60 described herein are preferably cast with the inner shroud 16 or machined into the inner shroud 16. Hence, a structural integrity and a complexity of manufacture of the grooves 60 are believed to be improved over ribs that are formed separately from and affixed to the inner shroud 16.

Figure 4:
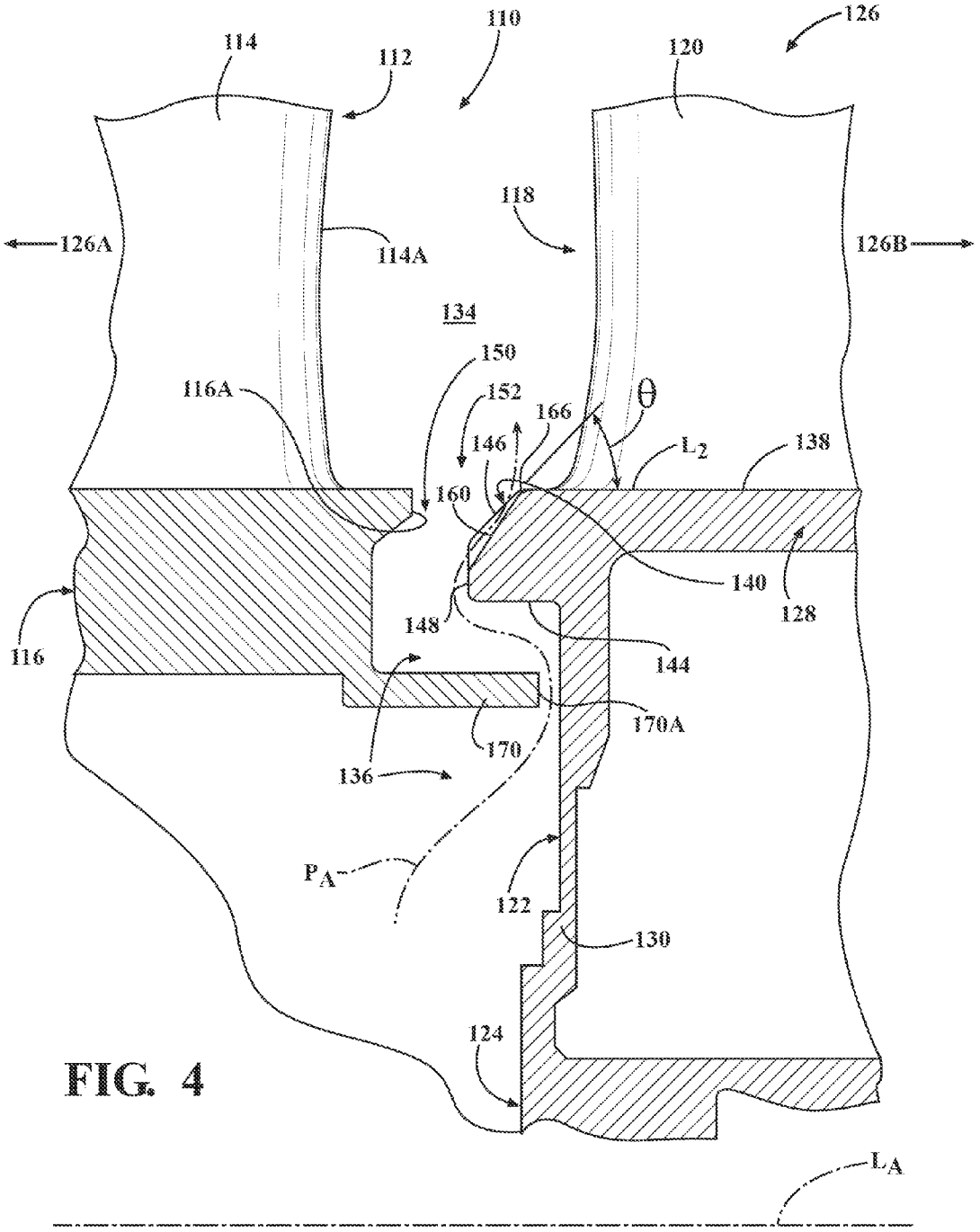
FIG. 4 is a diagrammatic sectional view of a portion of a turbine stage in a gas turbine engine including a seal assembly in accordance with another embodiment of the invention.

Referring to FIG. 4, a portion of a turbine engine 110 is illustrated, where structure similar to that described above with reference to FIGS. 1-3 includes the same reference number increased by 100. The engine 100 is illustrated diagrammatically and includes a stationary vane assembly 112 including a plurality of vanes 114 suspended from an outer casing (not shown) and affixed to an annular inner shroud 116, and a blade assembly 118 downstream from the vane assembly 112 and including a plurality of blades 120 and rotor disc structure 122 that forms a part of a turbine rotor 124 The vane assembly 112 and the blade assembly 118 may be collectively referred to herein as a "stage" of a turbine section 126 of the engine 110, which turbine section 126 may include a plurality of stages as will be apparent to those having ordinary skill in the art. The vane assemblies 112 and blade assemblies 118 are spaced apart from one another in an axial direction defining a longitudinal axis $L_A$ of the engine 110, wherein the vane assembly 112 illustrated in FIG. 4 is upstream from the illustrated blade assembly 118 with respect to an inlet 126A and an outlet 126B of the turbine section 126, see FIGS. 4 and 6.

The rotor disc structure 122 comprises a platform 128, a blade disc 130, and any other structure associated with the blade assembly 118 that rotates with the rotor 124 during operation of the engine 110, such as, for example, roots, side plates, shanks, etc, see FIG. 4.

The vanes 114 and the blades 120 extend into an annular hot gas path 134 defined within the turbine section 126 A working gas $H_G$ (see FIG. 6) comprising hot combustion gases is directed through the hot gas path 134 and flows past the vanes 114 and the blades 120 to remaining stages during operation of the engine 110. Passage of the working gas $H_G$ through the hot gas path 134 causes rotation of the blades 120 and the corresponding blade assembly 118 to provide rotation of the turbine rotor 124.

As shown in FIG. 4, a disc cavity 136 is located radially inwardly from the hot gas path 134 between the annular inner shroud 116 and the rotor disc structure 122. Purge air $P_A$, such as, for example, compressor discharge air, is provided into the disc cavity 136 to cool the inner shroud 116 and the rotor disc structure 122. The purge air $P_A$ also provides a pressure balance against the pressure of the working gas $H_G$ flowing through the hot gas path 134 to counteract a flow of the working gas $H_G$ into the disc cavity 136. The purge air $P_A$ may be provided to the disc cavity 136 from cooling passages (not shown) formed through the rotor 124 and/or from other upstream passages (not shown) as desired. It is noted that additional disc cavities (not shown) are typically provided between remaining inner shrouds 116 and corresponding adjacent rotor disc structures 122.

Figure 5:
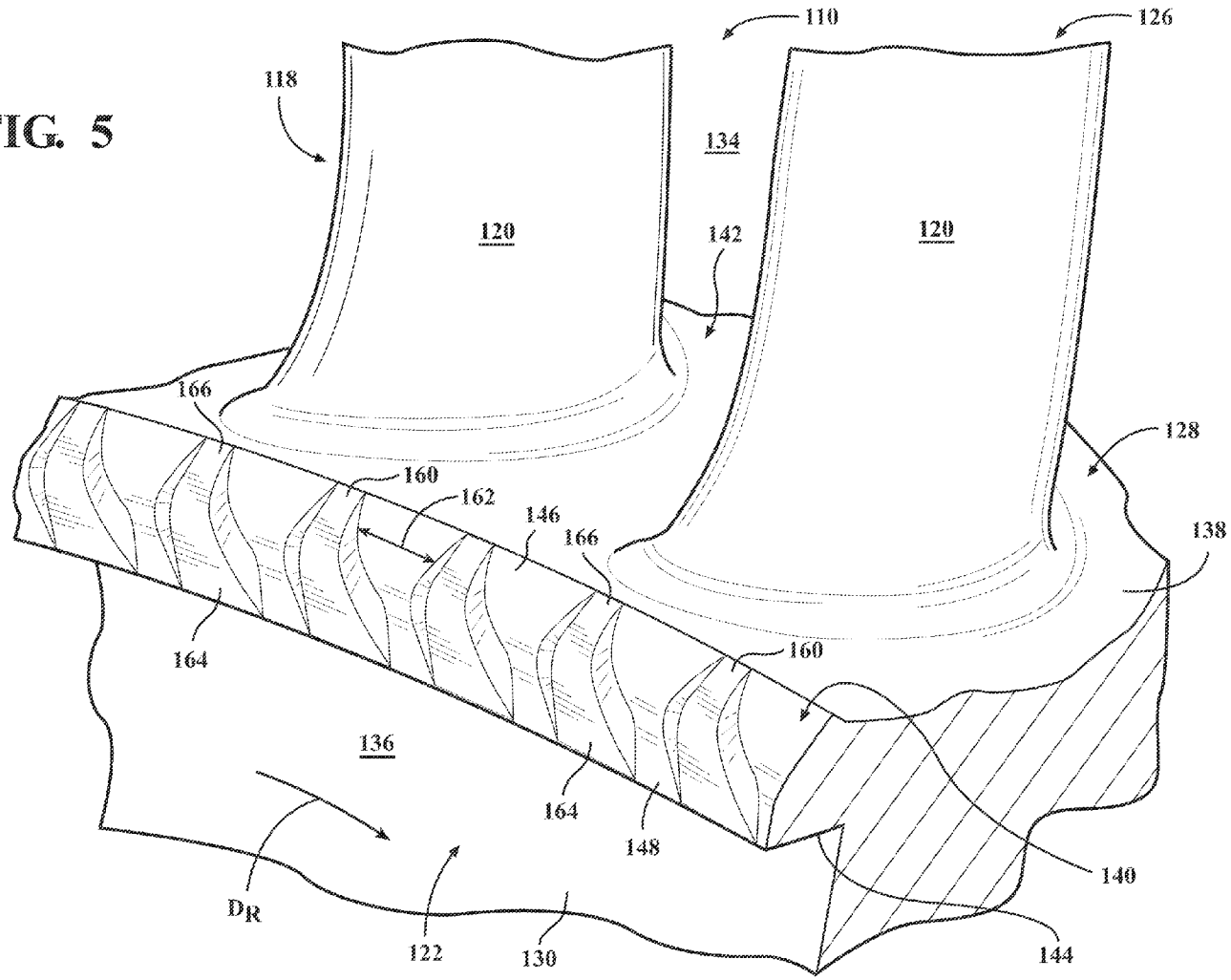
FIG. 5 is a fragmentary perspective view of a plurality of grooves of the seal assembly of FIG. 4.
Figure 6:
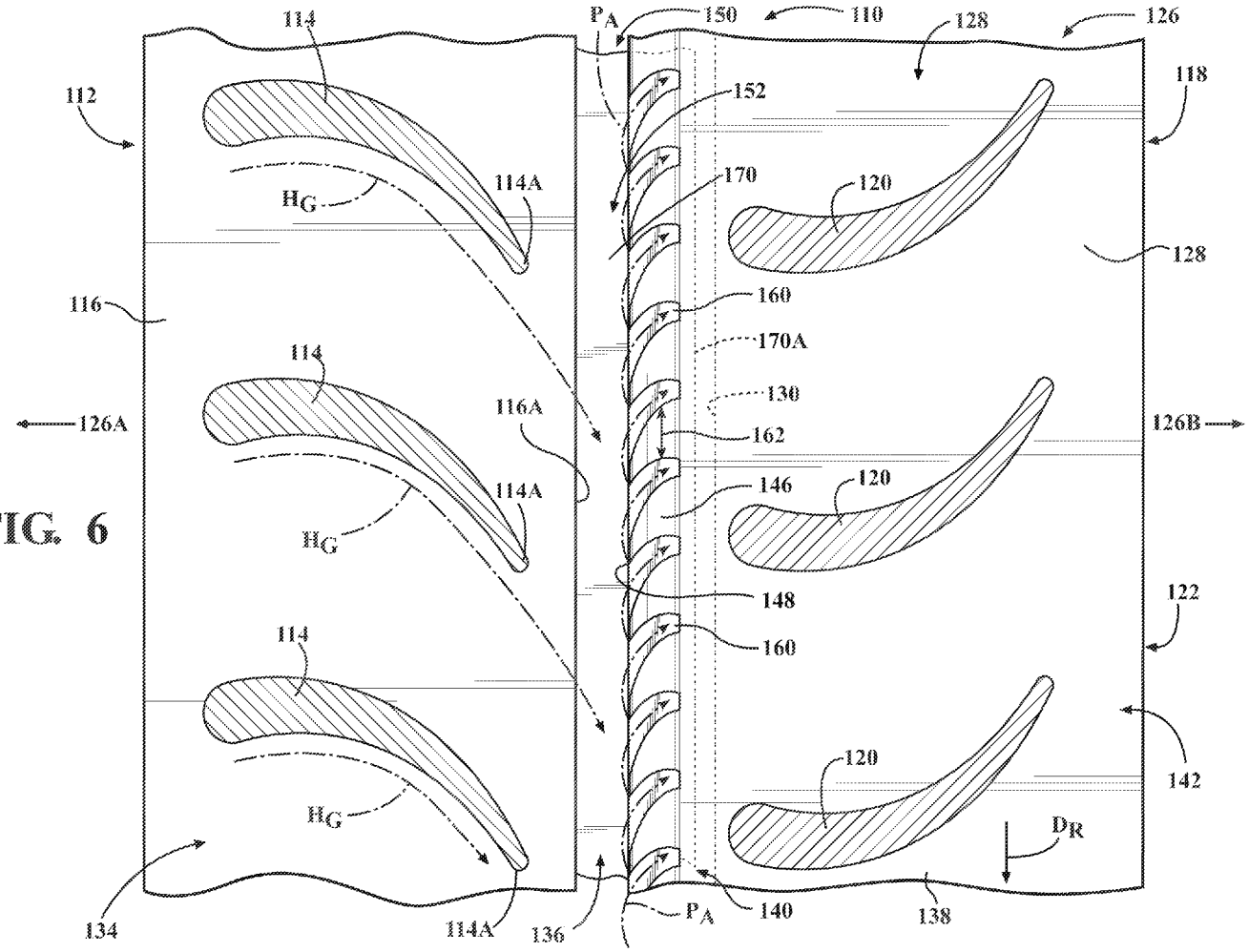
FIG. 6 is a cross sectional view of the stage illustrated in FIG. 4 looking in a radially inward direction.

Referring to FIGS. 4-6, the platform 128 in the embodiment shown comprises a generally radially outwardly facing first surface 138 from which the blades 120 extend. The first surface 138 in the embodiment shown extends from an axially upstream end portion 140 of the platform 128 to an axially downstream end portion 142, see FIGS. 5 and 6.

Figure 5A:
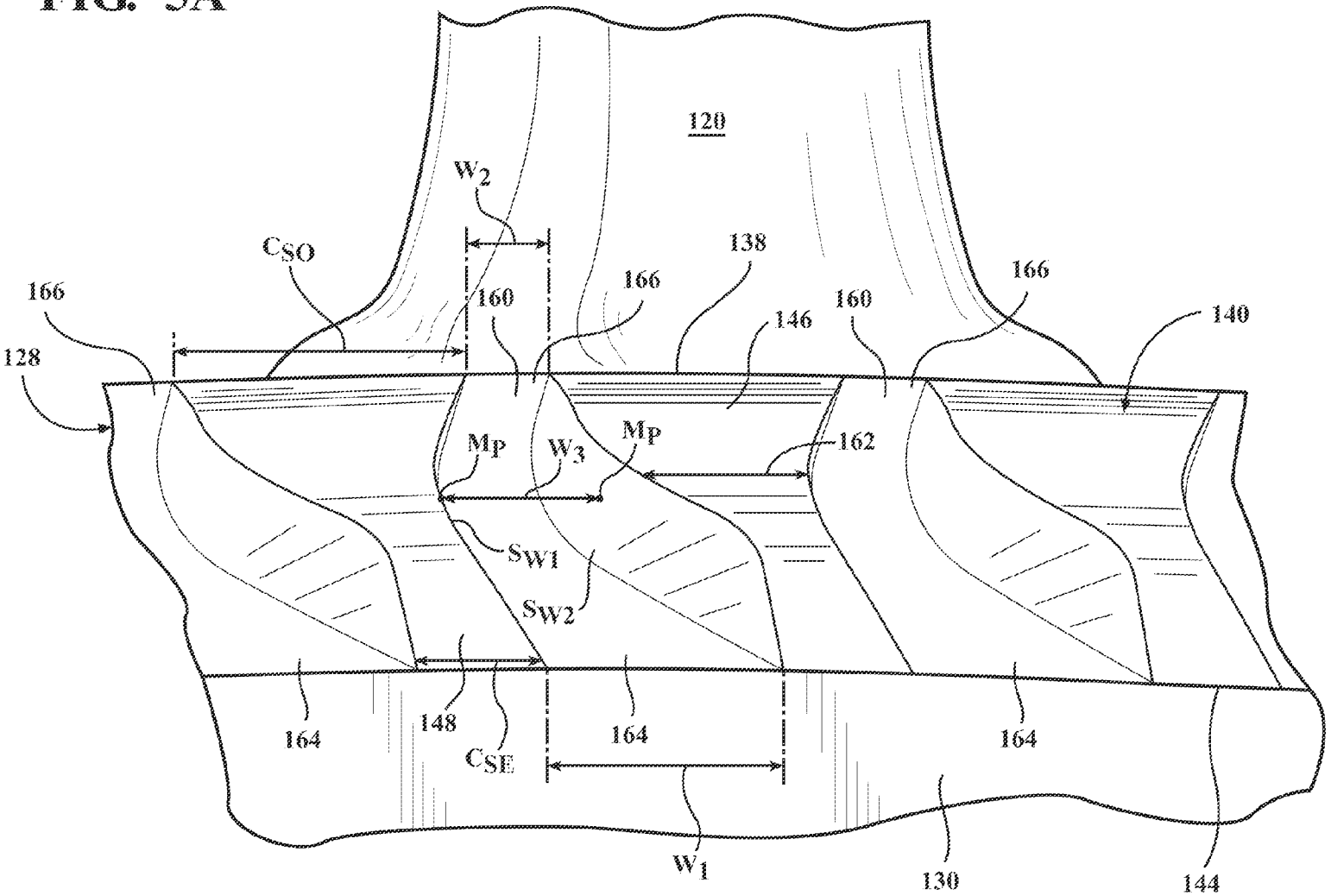
FIG. 5A is an elevational view of a number of the grooves illustrated in FIG. 4.

The platform 128 further comprises a radially inwardly facing second surface 144 that extends from the axially upstream end portion 140 of the platform 128 away from the adjacent vane assembly 112, see FIGS. 4, 5, and 5A.

The axially upstream end portion 140 of the platform 128 comprises a radially outwardly and axially upstream facing third surface 146, and a generally axially facing fourth surface 148 that extends from the third surface 146 to the second surface 144 and faces the inner shroud 116 of the adjacent vane assembly 112. The third surface 146 of the platform 128 in the embodiment shown extends from the first surface 138 at an angle θ relative to a line $L_2$ that is parallel to the longitudinal axis $L_A$, which angle θ is preferably between about 30-60° and is about 45° in the embodiment shown, see FIG. 4.

Components of the platform 128 and the adjacent inner shroud 116 radially inwardly from the respective blades 120 and vanes 114 cooperate to form an annular seal assembly 150 between the hot gas path 134 and the disc cavity 136. The annular seal assembly 150 assists in preventing ingestion of the working gas $H_G$ from the hot gas path 134 into the disc cavity 136 and delivers a portion of the purge air $P_A$ out of the disc cavity 136 in a desired direction with reference to a flow direction of the working gas $H_G$ through the hot gas path 134 as will be described herein It is noted that additional seal assemblies 150 similar to the one described herein may be provided between the platform 128 and the adjacent inner shroud 116 of the remaining stages in the engine 110, i.e., for assisting in preventing ingestion of the working gas $H_G$ from the hot gas path 134 into the respective disc cavities 136 and to deliver purge air $P_A$ out of the disc cavities 136 in a desired direction with reference to the flow direction of the working gas $H_G$ through the hot gas path 134 as will be described herein.

As shown in FIGS. 4-6, the seal assembly 150 comprises portions of the vane and blade assemblies 112, 118 Specifically, in the embodiment shown, the seal assembly 150 comprises the third and fourth surfaces 146, 148 of the platform 128 and an axially downstream end portion 116A of the inner shroud 116 of the adjacent vane assembly 112. These components cooperate to define an outlet 152 for the purge air $P_A$ out of the disc cavity 136, see FIGS. 4 and 6.

The seal assembly 150 further comprises a plurality of grooves 160, also referred to herein as blade grooves, extending into the third and fourth surfaces 146, 148 of the platform 128. The grooves 160 are arranged such that spaces 162 having components in a circumferential direction defined by a direction of rotation $D_R$ of the turbine rotor 124 and the rotor disc structure 122 are defined between adjacent grooves 160, see FIGS. 5, 5A, and 6 The size of the spaces 162 may vary depending on the particular configuration of the engine 110 and may be selected to fine tune discharging of purge air $P_A$ from the grooves 160, which discharging of the purge air $P_A$ from the grooves 160 will be discussed in more detail below As shown most clearly in FIG. 5A, entrances 164 of the grooves 160, i.e., where purge air $P_A$ from the disc cavity 136 to be discharged toward the hot gas path 134 enters the grooves 160, are located in the fourth surface 148 of the platform 128 distal from the first surface 138 of the platform 128. Outlets or exits 166 of the grooves 160, ie, where the purge air $P_A$ is discharged from the grooves 160, are located proximate to the first surface 138 of the platform 128 in the third surface 146 thereof. The grooves 160 are preferably tapered from the entrances 164 thereof to the exits 166 thereof such that widths $W_1$ of the groove entrances 164 are wider than widths $W_2$ of the groove exits 166, wherein the widths $W_1$, $W_2$ are respectively measured between opposing side walls $S_{W1}$, $S_{W2}$ of the platform 128 that define the grooves 160 with reference to directions substantially perpendicular to the general flow direction of the purge air $P_A$ passing through the respective grooves 160. The tapering of the grooves 160 in this manner is believed to provide a more concentrated and influential discharge of the purge air $P_A$ out of the grooves 160 so as to more effectively prevent ingestion of the working gas $H_G$ into the disc cavity 136 as will be described below.

Further, referring still to FIG. 5A, circumferential spacing $C_{SE}$ between adjacent groove entrances 164 is less than a circumferential width $W_3$ of each groove 160 at sidewall midpoints $M_P$ thereof, and circumferential spacing $C_{SO}$ between adjacent groove outlets 166 is greater than the circumferential width $W_3$ of each groove 160 at the sidewall midpoints $M_P$ thereof. These dimensions of the grooves 160 are believed to provide improved purge air $P_A$ flow performance out of the grooves 160, which will be discussed further below Referring to FIG. 5, the grooves 160 are also preferably angled and/or curved in the circumferential direction such that at least a portion of the entrances 164 thereof are located downstream from at least a portion of the exits 166 thereof with reference to the direction of rotation $D_R$ of the turbine rotor 124 and the rotor disc structure 122 Angling and/or curving the grooves 160 in this manner effects a guidance of the purge air $P_A$ from the disc cavity 136 out of the grooves 160 toward the hot gas path 134 such that the purge air $P_A$ flows in a desired direction with reference to the flow of the working gas $H_G$ through the hot gas path 134 Specifically, the grooves 160 according to this aspect of the invention guide the purge air $P_A$ out of the disc cavity 136 such that a flow direction of the purge air $P_A$ is generally aligned with a flow direction of the working gas $H_G$ at a corresponding axial location of the hot gas path 134, which flow direction of the working gas $H_G$ at the corresponding axial location of the hot gas path 134 is generally parallel to exit angles of trailing edges 114A of the vanes 114, see FIG. 6

As shown in FIGS. 4 and 6, the seal assembly 150 further comprises a generally axially extending seal structure 170 of the inner shroud 116 that extends toward the blade disc 130 of the blade assembly 118 An axial end 170A of the seal structure 170 is preferably in close proximity to the blade disc 130 of the blade assembly 118 such that the seal structure 170 overlaps the upstream end portion 140 of the platform 128. Such a configuration controls/limits the amount of cooling fluid that ultimately flows through the grooves 160 into the hot gas path 134, and also limits the amount of working gas $H_G$ ingestion into the portion of the disc cavity 136 located inwardly of the seal structure 170, i.e., any ingestion of working gas $H_G$ from the hot gas path 134 into the disc cavity 136 must travel through a tortuous path. The seal structure 170 may be formed as an integral part of the inner shroud 116, or may be formed separately from the inner shroud 116 and affixed thereto.

During operation of the engine 110, passage of the hot working gas $H_G$ through the hot gas path 134 causes the blade assembly 118 and the turbine rotor 124 to rotate in the direction of rotation $D_R$ shown in FIGS. 5 and 6.

A pressure differential between the disc cavity 136 and the hot gas path 134, i.e., the pressure in the disc cavity 136 is greater than the pressure in the hot gas path 134, causes purge air $P_A$ located in the disc cavity 136 to flow toward the hot gas path 134, see FIG. 4. As the purge air $P_A$ reaches the fourth surface 148 of the platform 128, a portion of the purge air $P_A$ flows into the entrances 164 of the grooves 160 This portion of the purge air $P_A$ flows radially outwardly through the grooves 160 and then, upon reaching the portions of the grooves 160 within the third surface 146 of the platform 128, the purge air $P_A$ flows radially outwardly and axially within the grooves 160 away from the adjacent upstream vane assembly 112. Due to the angling and/or curving of the grooves 160 as discussed above in combination with the rotation of the grooves 160 along with the turbine rotor 124 and the rotor disc structure 122 in the direction of rotation $D_R$, the purge air $P_A$ is provided with a circumferential velocity component such that the purge air $P_A$ is discharged out of the grooves 160 in generally the same direction as the working gas $H_G$ is flowing after exiting the trailing edges 114A of the upstream vanes 114, see FIG. 6

The discharge of the purge air $P_A$ from the grooves 160 assists in limiting ingestion of the hot working gas $H_G$ from the hot gas path 134 into the disc cavity 136 by forcing the working gas $H_G$ away from the seal assembly 150. Since the seal assembly 150 limits working gas $H_G$ ingestion from the hot gas path 134 into the disc cavity 136, the seal assembly 150 allows for a smaller amount of purge air $P_A$ to be provided to the disc cavity 136, ie., since the temperature of the purge air $P_A$ in the disc cavity 136 is not substantially raised by a large amount of working gas $H_G$ passing into the disc cavity 136, thus increasing engine efficiency Moreover, since the purge air $P_A$ is discharged out of the grooves 160 in generally the same direction that the working gas $H_G$ flows through the hot gas path 134 after exiting the trailing edges 114A of the upstream vanes 114, there is less pressure loss associated with the purge air $P_A$ mixing with the working gas $H_G$, thus additionally increasing engine efficiency. This is especially realized by the grooves 160 of the present invention since they are formed in the angled third surface 146 of the upstream end portion 140 of the platform 128, such that the purge air $P_A$ discharged from the grooves 160 flows axially in the downstream flow direction of the hot working gas $H_G$ through the hot gas path 134, in addition to the purge air $P_A$ being discharged from the grooves 160 in generally the same circumferential direction as the flow of hot working gas $H_G$ after exiting the trailing edges 114A of the upstream vanes 114, i.e., as a result of the grooves 160 rotating with the turbine rotor 124 and the rotor disc structure 122 and being angled and/or curved in the circumferential direction It is noted that the angle and/or curvature of the grooves 160 could be varied to fine tune the discharge direction of the purge air $P_A$ out of the grooves 160. This may be desirable based on the exit angles of trailing edges 114A of the vanes 114 and/or to vary the amount of pressure loss associated with the purge air $P_A$ mixing with the working gas $H_G$ flowing through the hot gas path 134.

It is also noted that the entrances 164 of the grooves 160 could be located further radially inwardly or outwardly in the fourth surface 148 of the platform 128, or the entrances 164 could be located in the third surface 146 of the platform 128, i.e., such that the entireties of the grooves 160 would be located in the third surface 146 of the platform 128.

The grooves 160 described herein are preferably cast with the platform 128 or machined into the platform 128. Hence, a structural integrity and a complexity of manufacture of the grooves 160 are believed to be improved over ribs that are formed separately from and affixed to the platform 128.

Figure 7:
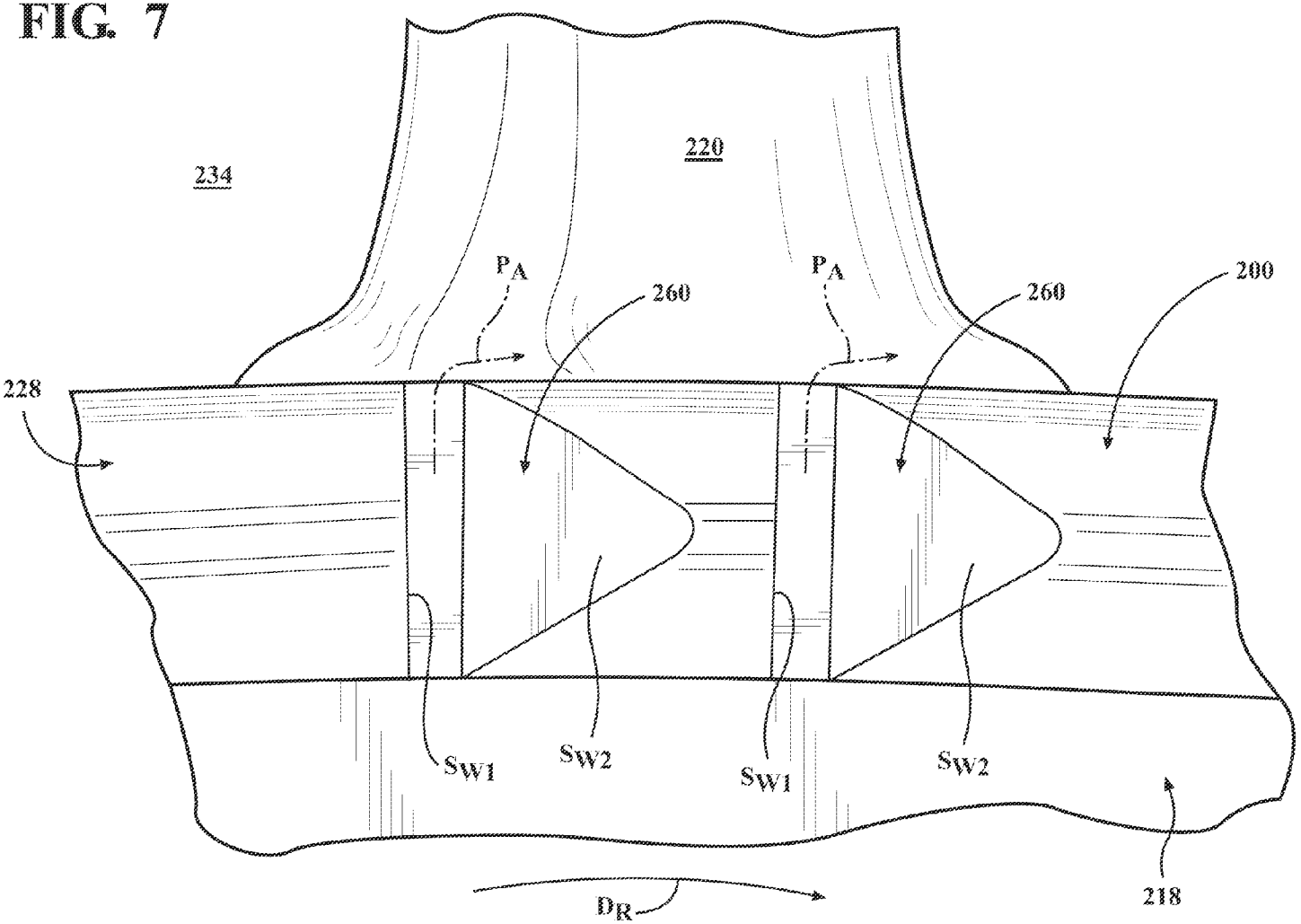
FIG. 7 is a view similar to the view of FIG. 5A and showing a seal assembly in accordance with another embodiment of the invention.

Referring now to FIG. 7, a seal assembly 200 according to a further aspect of the invention is shown, where structure similar to that described above with reference to FIGS. 4-6 includes the same reference number increased by 100. In this embodiment, grooves 260 formed in a blade platform 228 are formed by opposing first and second side walls $S_{W1}$, $S_{W2}$, wherein the first sidewall $SW_1$ comprises a generally radially extending and circumferentially facing wall, and the second sidewall $SW_2$ comprises a generally radially extending wall that faces in the axial and circumferential directions. While the side walls $S_{W1}$, $S_{W2}$ according to this embodiment are generally straight and thus do not themselves provide purge air $P_A$ passing out of the grooves 260 with a circumferential velocity component, since the blade assembly 218 that includes the platform 228 rotates during operation in the direction of rotation $D_R$ as described above with reference to FIGS. 4-6, the purge air $P_A$ passing out of the grooves 260 nonetheless includes a circumferential velocity component, ie., caused by rotation of the grooves 260 along with the blade assembly 218 in the direction of rotation $D_R$ Hence, the purge air $P_A$ passing out of the grooves 260 according to this aspect of the invention flows in generally the same direction as the hot working gas traveling along the hot gas flow path 234.

Figure 8:
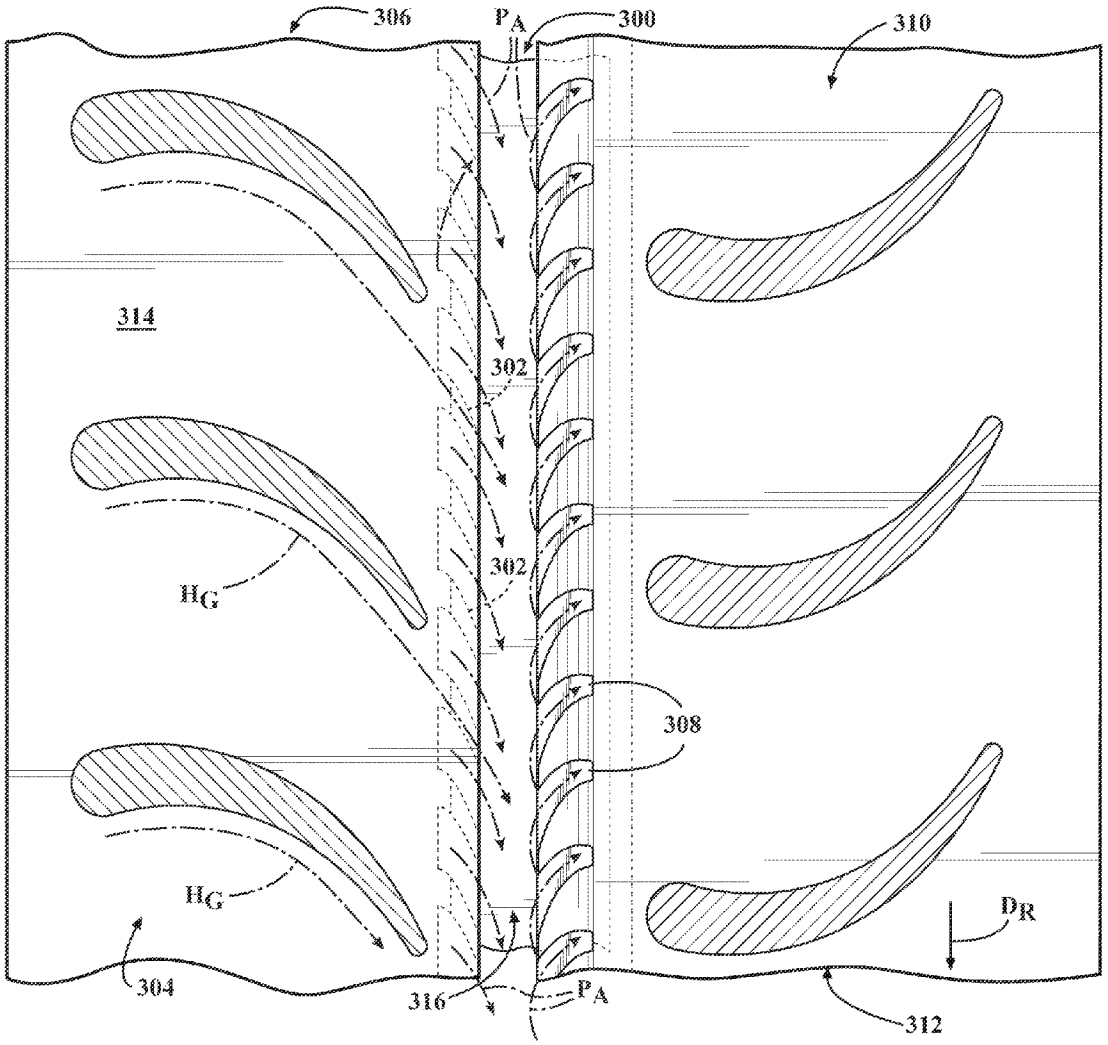
FIG. 8 is a view similar to the view of FIG. 6 and showing a seal assembly in accordance with another embodiment of the invention.

Referring now to FIG. 8, a seal assembly 300 according to a further aspect of the invention is shown. The seal assembly 300 illustrated in FIG. 8 includes first grooves 302 (also referred to herein as vane grooves) located in an inner shroud 304 of a stationary vane assembly 306, and second grooves 308 (also referred to herein as blade grooves) located in a platform 310 of a rotating blade assembly 312 The first grooves 302 may be substantially similar to the grooves 60 described above with reference to FIGS. 1-3, and the second grooves 308 may be substantially similar to the grooves 160 described above with reference to FIGS. 4-6. The seal assembly 300 according to this aspect of the invention may even further limit working gas $H_G$ ingestion from a hot gas path 314 into a disc cavity 316 associated with the seal assembly 300, thus allowing for an even smaller amount of purge air $P_A$ to be provided to the disc cavity 316 and thus further increasing engine efficiency Referring to FIG. 9, a portion of a turbine engine 410 is illustrated, where structure similar to that described above with reference to FIGS. 1-3 includes the same reference number increased by 400. The engine 410 is illustrated diagrammatically and includes a stationary vane assembly 412 including a plurality of vanes 414 suspended from an outer casing (not shown) and affixed to an annular inner shroud 416, and a blade assembly 418 upstream from the vane assembly 412 and including a plurality of blades 420 and rotor disc structure 422 that forms a part of a turbine rotor 424. The vane assembly 412 and the blade assembly 418 may be collectively referred to herein as a "stage" of a turbine section 426 of the engine 410, which turbine section 426 may include a plurality of stages as will be apparent to those having ordinary skill in the art. The vane assemblies 412 and blade assemblies 418 are spaced apart from one another in an axial direction defining a longitudinal axis $L_A$ of the engine 410, wherein the vane assembly 412 illustrated in FIG. 9 is downstream from the illustrated blade assembly 418 with respect to an inlet 426A and an outlet 426B of the turbine section 426, see FIGS. 9 and 11.

The rotor disc structure 422 comprises a platform 428, a blade disc 430, and any other structure associated with the blade assembly 418 that rotates with the rotor 424 during operation of the engine 410, such as, for example, roots, side plates, shanks, etc The vanes 414 and the blades 420 extend into an annular hot gas path 434 defined within the turbine section 426. A hot working gas $H_G$ (see FIG. 11) comprising hot combustion gases is directed through the hot gas path 434 and flows past the blades 420 and the vanes 414 to remaining stages during operation of the engine 410 Passage of the working gas $H_G$ through the hot gas path 434 causes rotation of the blades 420 and the corresponding blade assembly 418 to provide rotation of the turbine rotor 424.

As shown in FIG. 9, a disc cavity 436 is located radially inwardly from the hot gas path 434 between the annular inner shroud 416 and the rotor disc structure 422. Purge air $P_A$, such as, for example, compressor discharge air, is provided into the disc cavity 436 to cool the inner shroud 416 and the rotor disc structure 422 The purge air $P_A$ also provides a pressure balance against the pressure of the working gas $H_G$ flowing through the hot gas path 434 to counteract a flow of the working gas $H_G$ into the disc cavity 436. The purge air $P_A$ may be provided to the disc cavity 436 from cooling passages (not shown) formed through the rotor 424 and/or from other upstream passages (not shown) as desired. It is noted that additional disc cavities (not shown) are typically provided between remaining inner shrouds 416 and corresponding adjacent rotor disc structures 422.

Figure 10:
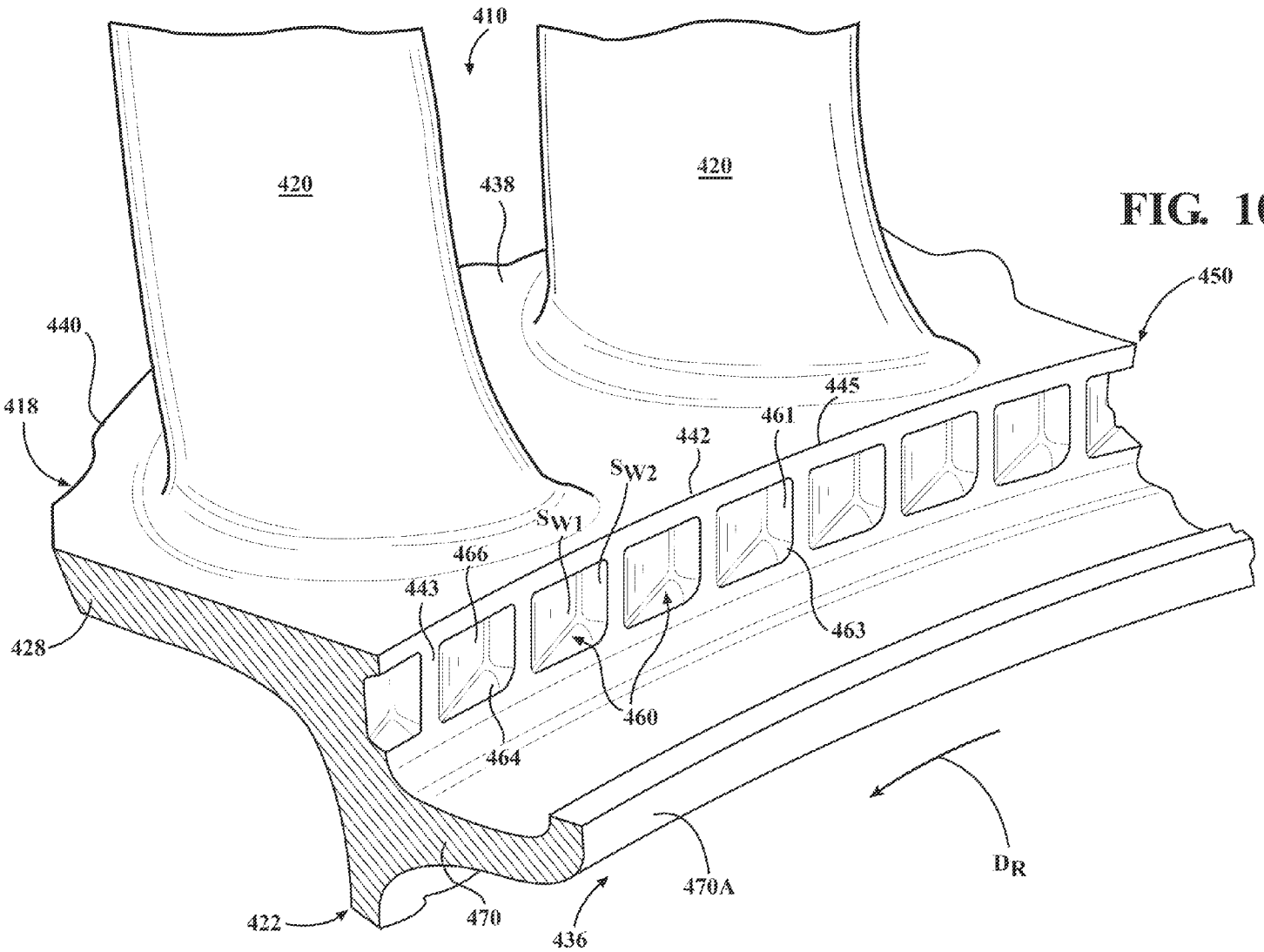
FIG. 10 is a fragmentary perspective view of a plurality of grooves of the seal assembly of FIG. 9.
Figure 11:
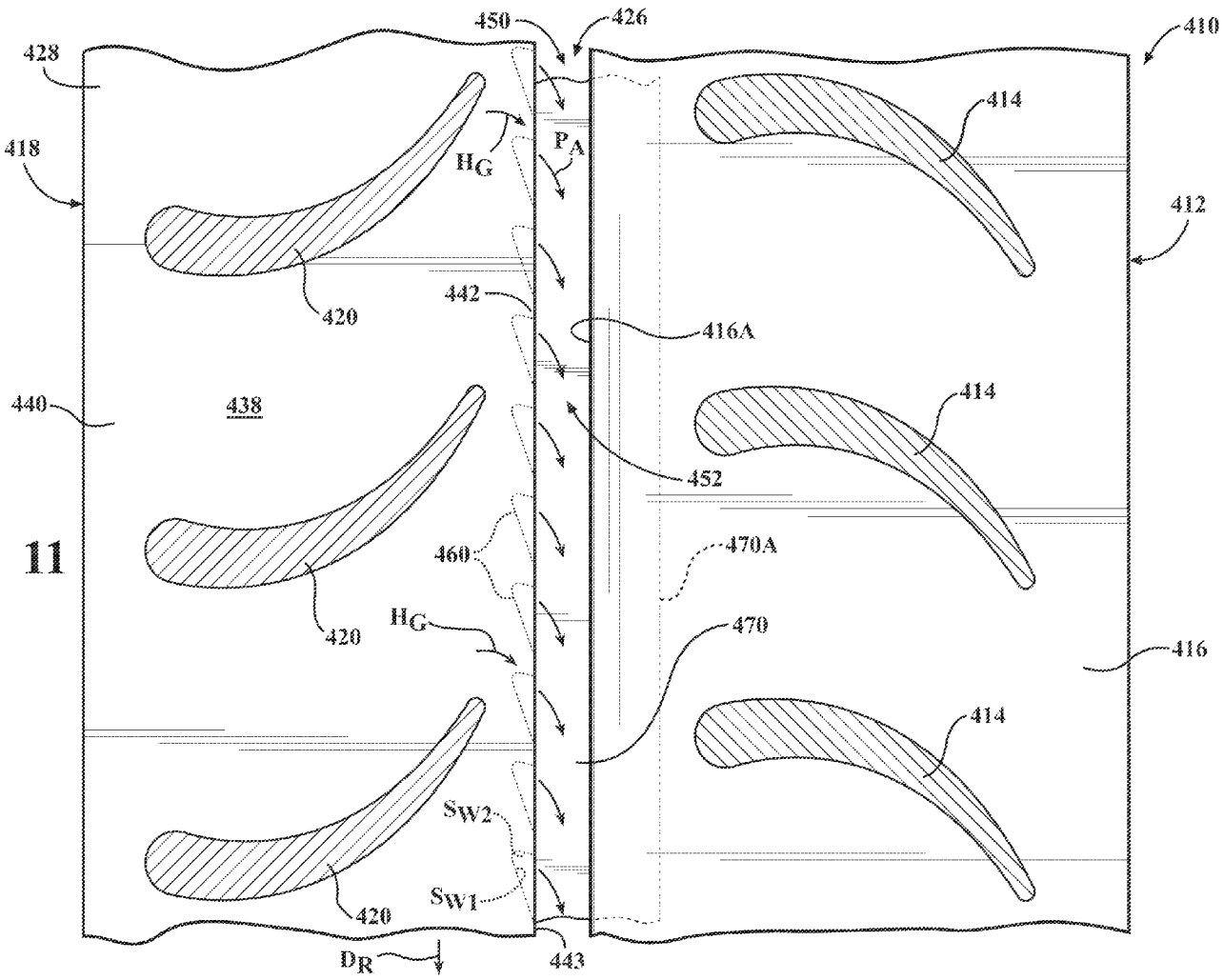
FIG. 11 is a cross sectional view of the stage illustrated in FIG. 9 looking in a radially inward direction.

Referring to FIGS. 9-11, the platform 428 in the embodiment shown comprises a generally radially outwardly facing first surface 438 from which the blades 420 extend The first surface 438 in the embodiment shown extends from an axially upstream end portion 440 of the platform 428 to an axially downstream end portion 442, see FIGS. 10 and 11.

The platform 428 further comprises an axially downstream facing second surface 443, i.e., facing the downstream vane assembly 412, which second surface 443 extends radially inwardly from a junction 445 between the first surface 438 and the second surface 443, see FIGS. 9-11. The second surface 443 defines an aft plane 447 that extends generally perpendicular to the longitudinal axis $L_A$ as shown in FIG. 9.

Components of the platform 428 and the adjacent inner shroud 416 radially inwardly from the respective blades 420 and vanes 414 cooperate to form an annular seal assembly 450 between the hot gas path 434 and the disc cavity 436. The annular seal assembly 450 assists in preventing ingestion of the working gas $H_G$ from the hot gas path 434 into the disc cavity 436 and delivers a portion of the purge air $P_A$ out of the disc cavity 436 in a desired direction with reference to a flow direction of the working gas $H_G$ through the hot gas path 434 as will be described herein. It is noted that additional seal assemblies 450 similar to the one described herein may be provided between the platform 428 and the adjacent inner shroud 416 of the remaining stages in the engine 410, ie, for assisting in preventing ingestion of the working gas $H_G$ from the hot gas path 434 into the respective disc cavities 436 and to deliver purge air $P_A$ out of the disc cavities 436 in a desired direction with reference to the flow direction of the working gas $H_G$ through the hot gas path 434 as will be described herein It is further noted that the other seal assemblies 50, 150, 200, 300 described herein, or other similar types of seal assemblies, may be used in combination with the seal assembly 450 of the present aspect of the invention Referring still to FIGS. 9-11, the seal assembly 450 according to this aspect of the invention comprises portions of the vane and blade assemblies 412, 418. Specifically, in the embodiment shown, the seal assembly 450 comprises the second surface 443 of the platform 428 and an axially upstream end portion 416A of the inner shroud 416 of the adjacent downstream vane assembly 412. These components cooperate to define an outlet 452 for the purge air $P_A$ out of the disc cavity 436, see FIGS. 9 and 11

The seal assembly 450 further comprises a plurality of grooves 460 or cutout portions extending into the second surface 443 of the platform 428 such that the grooves 460 are recessed from the aft plane 447 defined by the second surface 443 of the platform 428. The grooves 460 are arranged such that spaces 462 having components in a circumferential direction are defined between adjacent grooves 460 (see FIG. 10A), the circumferential direction defined by a direction of rotation $D_R$ of the turbine rotor 424, the rotor disc structure 422, and the blade assembly 418. The size of the spaces 462 may vary depending on the particular configuration of the engine 410 and may be selected to fine tune the discharge of purge air $P_A$ from the grooves 460, which discharge of the purge air $P_A$ from the grooves 460 will be discussed in more detail below As shown most clearly in FIG. 10A, entrances 464 of the grooves 460 defined at radially inner ends 464A of the grooves 460, ie, where purge air $P_A$ from the disc cavity 436 to be discharged toward the hot gas path 434 enters the grooves 460, are located in the second surface 443 of the platform 428 distal from the first surface 438 of the platform 428. Outlets or exits 466 of the grooves 460 defined at radially outer ends 466A of the grooves 460, i.e, where the purge air $P_A$ is discharged from the grooves 460, are located closer to the first surface 438 of the platform 428 and include radially inwardly and axially downstream facing exit walls 466B, see FIG. 9 While the exits 466 of the grooves 460 are located closer to the first surface 438 of the platform 428 than the groove entrances 464, as most clearly shown in FIG. 10A, the groove exits 466 are radially displaced a distance D from the junction 445 between first and second surfaces 438, 443 of the platform 428. Due to the groove exits 466 being radially displaced from the junction 445, the purge air $P_A$ cannot exit the grooves 460 in a linear radially outward direction, i.e., the purge air $P_A$ passing out of the grooves 460 is provided with an axial velocity component in the downstream direction, as will be discussed further herein with reference to FIG. 11A First sidewalls $S_{W1}$ of the grooves 460 extend from the aft plane 447 defined by the second surface 443 of the platform 428 to second sidewalls $S_{W2}$ of the grooves 460, wherein the first sidewalls $S_{W1}$ are located circumferentially upstream from the second sidewalls $S_{W2}$ with reference to the direction of rotation $D_R$ In the exemplary embodiment shown, the first sidewalls $S_{W1}$ of the grooves 460 are generally planar walls that extend gradually farther into the platform 428 as they extend toward the second sidewalls $S_{W2}$, such that axial depths of the grooves 460, corresponding to a dimension of the grooves 460 into the second surface 443 of the platform 428, increase gradually from the commencement of the first sidewalls $S_{W1}$, i.e., where the first sidewalls $S_{W1}$ extend from the second surface 443 of the platform 428, to the second sidewalls $S_{W2}$, as shown most clearly in FIGS. 10 and 11

Figure 10A:
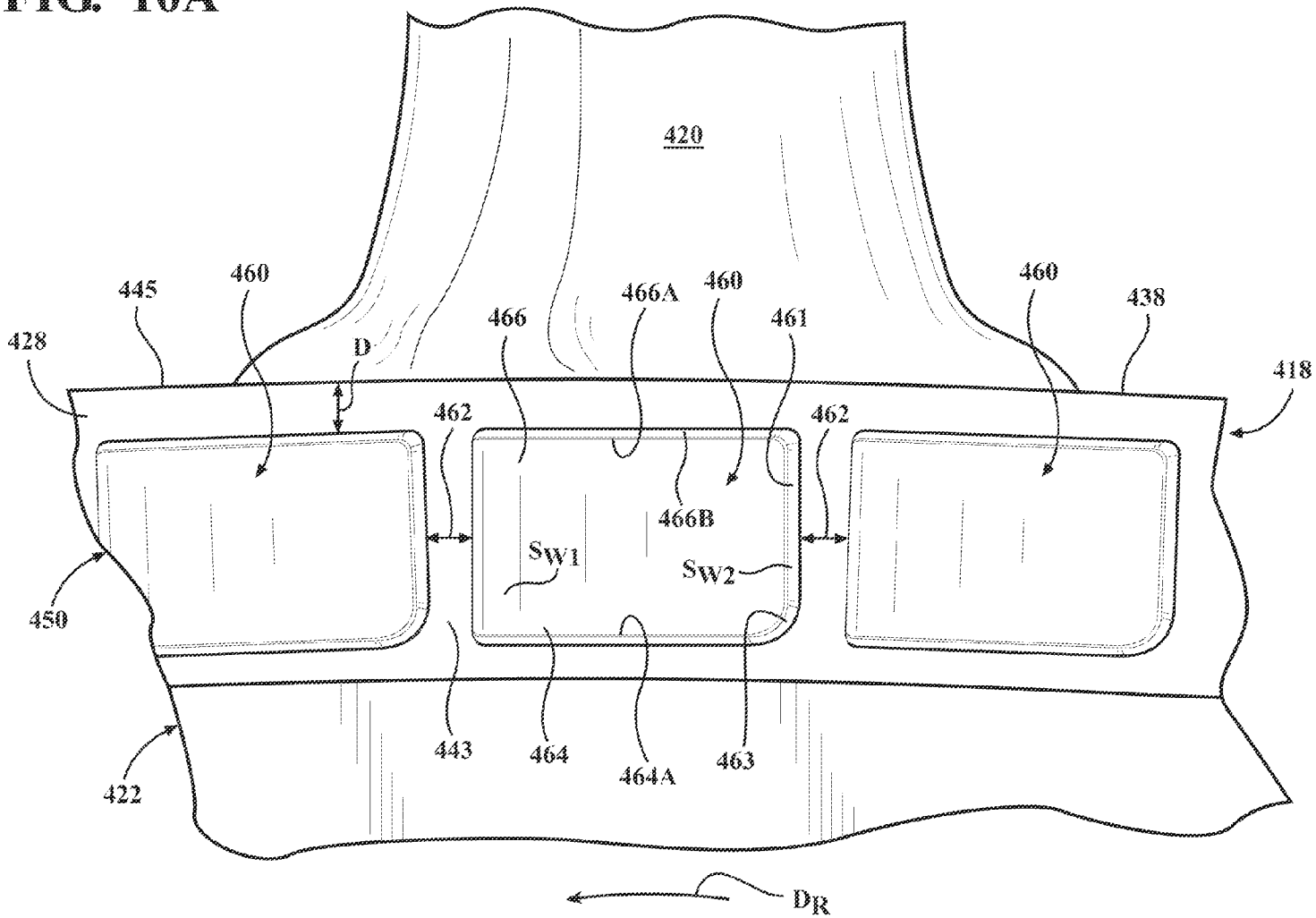
FIG. 10A is an elevational view of a number of the grooves illustrated in FIG. 9.

The second sidewalls $S_{W2}$ of the grooves 460 include a generally planar circumferentially facing endwall 461 that extends generally radially outwardly from the groove entrances 464 to the groove exits 466, although radially inner corner portions 463 of the endwalls 461 may be curved or angled in the circumferentially upstream direction as shown in FIG. 10A to create a ramped surface for cooling air passing through the grooves 460, as will be discussed in more detail below As shown in FIGS. 9-11, the seal assembly 450 further comprises a generally axially extending seal structure 470 of the platform 428 that extends toward the inner shroud 416 of the downstream vane assembly 418 An axial end 470A of the seal structure 470 preferably extends to within close proximity of the inner shroud 416 such that the seal structure 470 overlaps the upstream end portion 416A of the inner shroud 416. Such a configuration controls/limits the amount of cooling fluid that ultimately flows through the grooves 460 into the hot gas path 434, and also limits the amount of working gas $H_G$ ingestion into the portion of the disc cavity 436 located inwardly of the seal structure 470, i.e., any ingestion of working gas $H_G$ from the hot gas path 434 into the disc cavity 436 must travel through a tortuous path. The seal structure 470 may be formed as an integral part of the platform 428, or may be formed separately from the platform 428 and affixed thereto.

During operation of the engine 410, passage of the hot working gas $H_G$ through the hot gas path 434 causes the blade assembly 418 and the turbine rotor 424 to rotate in the direction of rotation $D_R$ shown in FIGS. 10 and 11.

A pressure differential between the disc cavity 436 and the hot gas path 434, i.e., the pressure in the disc cavity 436 is greater than the pressure in the hot gas path 434, causes purge air $P_A$ located in the disc cavity 436 to flow toward the hot gas path 434, see FIG. 9. As the purge air $P_A$ reaches the second surface 443 of the platform 428, a portion of the purge air $P_A$ flows into the entrances 464 of the grooves 460 This portion of the purge air $P_A$ flows radially outwardly through the grooves 460 and then out of the groove exits 466. It is noted that the angling and/or curving of the corner portions 463 of the endwalls 461 of the second sidewalls $SW_2$ as discussed above creates a scooping effect to push the purge air $P_A$ radially outwardly within the grooves 460 toward the exits 466.

Further, the rotation of the grooves 460 along with the turbine rotor 424 and the rotor disc structure 422 in the direction of rotation $D_R$ provides the purge air $P_A$ with a circumferential velocity component $VP_C$ (see FIG. 11A), wherein the purge air $P_A$ discharged out of the grooves 460 is preferably generally aligned in the circumferential direction with the hot working gas $H_G$ flowing through the hot gas path 434 at axial locations corresponding to where the purge air $P_A$ exits the grooves 460 More specifically, the purge air $P_A$ discharged out of the grooves 460 includes a total velocity vector $VP_T$ that includes both circumferential and axial velocity components $VP_C$, $VP_A$, as shown in FIG. 11A While the axial velocity component $VP_A$ of the purge air $P_A$ does not approach an axial velocity component $VW_A$ of the hot working gas $H_G$ flowing through the hot gas path 343, which includes a resultant velocity vector $VW_T$ as shown in FIG. 11A, the resultant velocity vector $VP_T$ of the purge air $P_A$ is generally aligned with the resultant velocity vector $VW_T$ of the hot working gas.

It is noted that the flow directions of the purge air $P_A$ and hot working gas $H_G$ shown in FIG. 11 are illustrated with reference to a stationary component in the engine 410.

The discharge of the purge air $P_A$ from the grooves 460 assists in limiting ingestion of the hot working gas $H_G$ from the hot gas path 434 into the disc cavity 436 by forcing the working gas $H_G$ away from the seal assembly 450 Since the seal assembly 450 limits working gas $H_G$ ingestion from the hot gas path 434 into the disc cavity 436, the seal assembly 450 allows for a smaller amount of purge air $P_A$ to be provided to the disc cavity 436, i.e., since the temperature of the purge air $P_A$ in the disc cavity 436 is not substantially raised by a large amount of working gas $H_G$ passing into the disc cavity 436. Providing a smaller amount of purge air $P_A$ into the disc cavity 436 increases engine efficiency.

Moreover, since the purge air $P_A$ is discharged circumferentially out of the grooves 460 in generally the same circumferential direction as the working gas $H_G$ flows through the hot gas path 434 at axial locations corresponding to where the purge air $P_A$ exits the grooves 460, there is less pressure loss associated with the purge air $P_A$ mixing with the working gas $H_G$, thus additionally increasing engine efficiency. This is especially realized by the grooves 460 of the present invention since the exits 466 of the grooves 460 are displaced from the junction 445 between the first and second surfaces 438, 443 of the platform 428, such that the purge air $P_A$ discharged from the grooves 460 flows axially in the downstream flow direction of the hot working gas $H_G$, in addition to the purge air $P_A$ being discharged from the grooves 460 in generally the same circumferential direction as the flow of hot working gas $H_G$ at axial locations corresponding to where the purge air $P_A$ exits the grooves 460, ie., as a result of the grooves 460 rotating with the turbine rotor 424 and the rotor disc structure 422

The grooves 460 described herein are preferably cast with the platform 428 or machined into the platform 428 Hence, a structural integrity and a complexity of manufacture of the grooves 460 are believed to be improved over ribs that may be formed separately from and affixed to the platform 428.

As noted above, the seal assembly 450 of FIGS. 9-11 could be used in combination with the seal assemblies 50, 150, 200, 300 of any of FIGS. 1-8 If used in combination, the seal assemblies 50, 150, 200, 300, 450 described herein could even further reduce the amount of purge air $P_A$ provided to the respective disc cavities, thus even further increasing engine efficiency.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly between a disc cavity and a hot gas path that extends through a turbine section of a gas turbine engine comprising:

a stationary vane assembly including a plurality of vanes and an inner shroud; and a rotating blade assembly axially upstream from the vane assembly and including a plurality of blades that are supported on a platform and rotate with a turbine rotor and the platform during operation of the engine, the axial direction defined by a longitudinal axis of the turbine section, the platform comprising:

a radially outwardly facing first surface;

an axially downstream facing second surface extending radially inwardly from a junction between the first surface and the second surface, the second surface defining an aft plane; and a plurality of grooves extending into the second surface such that the grooves are recessed from the aft plane defined by the second surface, wherein the grooves are arranged such that a space having a component in a circumferential direction is defined between adjacent grooves, the circumferential direction corresponding to a direction of rotation of the blade assembly;

wherein, during operation of the engine, the grooves impart a circumferential velocity component to purge air flowing out of the disc cavity through the grooves to guide the purge air toward the hot gas path such that the purge air flows in a desired direction with reference to a direction of hot gas flow through the hot gas path;

wherein the grooves include first sidewalls and second sidewalls, the first sidewalls being located circumferentially upstream from the second sidewalls; and wherein the second sidewalls of the grooves include a generally planar circumferentially facing endwall that extends generally radially outwardly from entrances of the grooves to exits thereof.

2. The seal assembly according to claim 1, wherein axial depths of the grooves increase gradually from the first sidewalls to the second sidewalls.

3. The seal assembly according to claim 1, wherein radially inner corner portions of the endwalls of the grooves are curved in the circumferentially upstream direction to create a ramped surface for cooling air passing through the grooves.

4. The seal assembly according to claim 1, wherein exits of the grooves are radially displaced from the junction between first and second surfaces of the platform.

5. The seal assembly according to claim 4, wherein the grooves include radially outer exit walls defining the exits of the grooves and that face radially inwardly and axially downstream.

6. The seal assembly according to claim 1, wherein the grooves guide the purge air therethrough such that a flow direction of the purge air exiting the grooves is generally aligned with the direction of hot gas flow through the hot gas path at axial locations corresponding to where the purge air exits the grooves.

7. The seal assembly according to claim 1, wherein the platform further comprises a generally axially extending seal structure that extends from the platform toward and to within close proximity of the inner shroud of the adjacent downstream vane assembly.

8. The seal assembly according to claim 1, wherein the platform further comprises:

a third surface facing an axially upstream direction; and a plurality of blade grooves extending into the third surface of the platform, the blade grooves being arranged such that a space having a component in the circumferential direction is defined between adjacent blade grooves, wherein, during operation of the engine, the blade grooves guide purge air out of an axially upstream disc cavity toward the hot gas path such that the purge air flows in a desired direction with reference to the direction of hot gas flow through the hot gas path.

9. The seal assembly according to claim 8, wherein the third surface of the platform faces axially upstream and radially outwardly.

10. The seal assembly according to claim 8, wherein the inner shroud comprises:

a radially outwardly facing first surface;

a radially inwardly facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide purge air toward the hot gas path such that the purge air flows in a desired direction with reference to the direction of hot gas flow through the hot gas path.

11. The seal assembly according to claim 10, wherein the second surface of the inner shroud faces axially downstream and radially inwardly.

12. The seal assembly according to claim 10, wherein:

the blade grooves are tapered from entrances thereof located distal from the first surface of the platform to exits thereof located proximate to the first surface of the platform such that the entrances of the blade grooves are wider than the exits of the blade grooves; and the vane grooves are tapered from entrances thereof located distal from an axial end portion of the inner shroud to exits thereof located proximate to the axial end portion of the inner shroud such that the entrances of the vane grooves are wider than the exits of the vane grooves.

13. A seal assembly between a disc cavity and a hot gas path that extends through a turbine section of a gas turbine engine comprising:

a stationary vane assembly including a plurality of vanes and an inner shroud; and a rotating blade assembly axially upstream from the vane assembly and including a plurality of blades that are supported on a platform and rotate with a turbine rotor and the platform during operation of the engine, the axial direction defined by a longitudinal axis of the turbine section, the platform comprising:

a radially outwardly facing first surface;

an axially downstream facing second surface extending radially inwardly from a junction between the first surface and the second surface, the second surface defining an aft plane; and a plurality of grooves extending into the second surface such that the grooves are recessed from the aft plane defined by the second surface, wherein:

the grooves are arranged such that a space having a component in a circumferential direction is defined between adjacent grooves, the circumferential direction corresponding to a direction of rotation of the blade assembly;

axial depths of the grooves increase from first sidewalls of the grooves to second sidewalls of the grooves spaced circumferentially downstream from the first sidewalls; and exits of the grooves are radially displaced from the junction between first and second surfaces of the platform;

wherein, during operation of the engine, the grooves impart a circumferential velocity component to purge air flowing out of the disc cavity through the grooves to guide the purge air therethrough such that a flow direction of the purge air exiting the grooves is generally aligned with a direction of hot gas flow through the hot gas path at axial locations corresponding to where the purge air exits the grooves; and wherein:

the second sidewalls of the grooves include a generally planar circumferentially facing endwall that extends generally radially outwardly from entrances of the grooves to the exits of the grooves;

radially inner corner portions of the endwalls of the grooves are curved in the circumferentially upstream direction to create a ramped surface for cooling air passing through the grooves; and the grooves include radially outer exits walls defining the exits of the grooves and that face radially inwardly and axially downstream.

14. The seal assembly according to claim 13, wherein the platform further comprises a generally axially extending seal structure that extends from the platform toward and to within close proximity of the inner shroud of the adjacent downstream vane assembly.

15. The seal assembly according to claim 13, wherein the platform further comprises:

a third surface facing an axially upstream direction and radially outwardly; and a plurality of blade grooves extending into the third surface of the platform, the blade grooves being arranged such that a space having a component in the circumferential direction is defined between adjacent blade grooves, wherein, during operation of the engine, the blade grooves guide purge air out of an axially upstream disc cavity toward the hot gas path such that the purge air flows in a desired direction with reference to the direction of hot gas flow through the hot gas path.

16. The seal assembly according to claim 15, wherein the inner shroud comprises:

a radially outwardly facing first surface;

a radially inwardly and axially downstream facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide purge air out of an axially downstream disc cavity toward the hot gas path such that the purge air flows in a desired direction with reference to the direction of hot gas flow through the hot gas path.

17. The seal assembly according to claim 16, wherein:

the blade grooves are tapered from entrances thereof located distal from the first surface of the platform to exits thereof located proximate to the first surface of the platform such that the entrances of the blade grooves are wider than the exits of the blade grooves; and the vane grooves are tapered from entrances thereof located distal from an axial end portion of the inner shroud to exits thereof located proximate to the axial end portion of the inner shroud such that the entrances of the vane grooves are wider than the exits of the vane grooves.

18. A seal assembly between a disc cavity and a hot gas path that extends through a turbine section of a gas turbine engine comprising:

a stationary vane assembly including a plurality of vanes and an inner shroud; and a rotating blade assembly axially upstream from the vane assembly and including a plurality of blades that are supported on a platform and rotate with a turbine rotor and the platform during operation of the engine, the axial direction defined by a longitudinal axis of the turbine section, the platform comprising:

a radially outwardly facing first surface;

an axially downstream facing second surface extending radially inwardly from a junction between the first surface and the second surface, the second surface defining an aft plane; and a plurality of grooves extending into the second surface such that the grooves are recessed from the aft plane defined by the second surface, wherein the grooves are arranged such that a space having a component in a circumferential direction is defined between adjacent grooves, the circumferential direction corresponding to a direction of rotation of the blade assembly;

wherein, during operation of the engine, the grooves impart a circumferential velocity component to purge air flowing out of the disc cavity through the grooves to guide the purge air toward the hot gas path such that the purge air flows in a desired direction with reference to a direction of hot gas flow through the hot gas path;

wherein the platform further comprises:

a third surface facing an axially upstream direction; and a plurality of blade grooves extending into the third surface of the platform, the blade grooves being arranged such that a space having a component in the circumferential direction is defined between adjacent blade grooves, wherein, during operation of the engine, the blade grooves guide purge air out of an axially upstream disc cavity toward the hot gas path such that the purge air flows in a desired direction with reference to the direction of hot gas flow through the hot gas path;

wherein the inner shroud comprises:

a radially outwardly facing first surface;

a radially inwardly facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide purge air toward the hot gas path such that the purge air flows in a desired direction with reference to the direction of hot gas flow through the hot gas path; and wherein:

the blade grooves are tapered from entrances thereof located distal from the first surface of the platform to exits thereof located proximate to the first surface of the platform such that the entrances of the blade grooves are wider than the exits of the blade grooves; and the vane grooves are tapered from entrances thereof located distal from an axial end portion of the inner shroud to exits thereof located proximate to the axial end portion of the inner shroud such that the entrances of the vane grooves are wider than the exits of the vane grooves.

19. A seal assembly between a disc cavity and a hot gas path that extends through a turbine section of a gas turbine engine comprising:

a stationary vane assembly including a plurality of vanes and an inner shroud; and a rotating blade assembly axially upstream from the vane assembly and including a plurality of blades that are supported on a platform and rotate with a turbine rotor and the platform during operation of the engine, the axial direction defined by a longitudinal axis of the turbine section, the platform comprising:

a radially outwardly facing first surface;

an axially downstream facing second surface extending radially inwardly from a junction between the first surface and the second surface, the second surface defining an aft plane; and a plurality of grooves extending into the second surface such that the grooves are recessed from the aft plane defined by the second surface, wherein:

the grooves are arranged such that a space having a component in a circumferential direction is defined between adjacent grooves, the circumferential direction corresponding to a direction of rotation of the blade assembly;

axial depths of the grooves increase from first sidewalls of the grooves to second sidewalls of the grooves spaced circumferentially downstream from the first sidewalls; and exits of the grooves are radially displaced from the junction between first and second surfaces of the platform;

wherein, during operation of the engine, the grooves impart a circumferential velocity component to purge air flowing out of the disc cavity through the grooves to guide the purge air therethrough such that a flow direction of the purge air exiting the grooves is generally aligned with a direction of hot gas flow through the hot gas path at axial locations corresponding to where the purge air exits the grooves;

wherein the platform further comprises:

a third surface facing an axially upstream direction and radially outwardly; and a plurality of blade grooves extending into the third surface of the platform, the blade grooves being arranged such that a space having a component in the circumferential direction is defined between adjacent blade grooves, wherein, during operation of the engine, the blade grooves guide purge air out of an axially upstream disc cavity toward the hot gas path such that the purge air flows in a desired direction with reference to the direction of hot gas flow through the hot gas path;

wherein the inner shroud comprises:

a radially outwardly facing first surface;

a radially inwardly and axially downstream facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide purge air out of an axially downstream disc cavity toward the hot gas path such that the purge air flows in a desired direction with reference to the direction of hot gas flow through the hot gas path; and wherein:

the blade grooves are tapered from entrances thereof located distal from the first surface of the platform to exits thereof located proximate to the first surface of the platform such that the entrances of the blade grooves are wider than the exits of the blade grooves; and the vane grooves are tapered from entrances thereof located distal from an axial end portion of the inner shroud to exits thereof located proximate to the axial end portion of the inner shroud such that the entrances of the vane grooves are wider than the exits of the vane grooves.

* * * * *